US011306553B2

(12) United States Patent
Sorensen

(10) Patent No.: US 11,306,553 B2
(45) Date of Patent: Apr. 19, 2022

(54) WELL ACCESS APPARATUS AND METHOD

(71) Applicant: Quality Intervention Technology AS, Balestrand (NO)

(72) Inventor: Bjorn Bro Sorensen, Notteroy (NO)

(73) Assignee: Quality Intervention Technology AS, Balestrand (NO)

( * ) Notice: Subject to any disclaimer, the term of this patent is extended or adjusted under 35 U.S.C. 154(b) by 0 days.

(21) Appl. No.: 16/488,036

(22) PCT Filed: Feb. 23, 2018

(86) PCT No.: PCT/EP2018/054601
§ 371 (c)(1),
(2) Date: Aug. 22, 2019

(87) PCT Pub. No.: WO2018/154087
PCT Pub. Date: Aug. 30, 2018

(65) Prior Publication Data

US 2020/0063514 A1 Feb. 27, 2020

(30) Foreign Application Priority Data

Feb. 23, 2017 (GB) ..... 1702936

(51) Int. Cl.
*E21B 23/03* (2006.01)
*E21B 19/22* (2006.01)
(Continued)

(52) U.S. Cl.
CPC ..... *E21B 23/03* (2013.01); *E21B 19/22* (2013.01); *E21B 23/08* (2013.01); *E21B 33/072* (2013.01)

(58) Field of Classification Search
CPC ..... E21B 23/03; E21B 23/08; E21B 19/22; E21B 33/072
See application file for complete search history.

(56) References Cited

U.S. PATENT DOCUMENTS 4,091,867 A * 5/1978 Shannon, Jr. ..... E21B 19/22 166/77.3
6,186,239 B1 2/2001 Monjure et al.
(Continued)

FOREIGN PATENT DOCUMENTS

GB 2484820 A 4/2012
WO WO 2010/014326 A1 2/2010
(Continued)

OTHER PUBLICATIONS

International Search Report and Written Opinion of International Application No. PCT/EP2018/054601 dated Oct. 1, 2018, 20 pages.
(Continued)

*Primary Examiner* — Dany E Akakpo
(74) *Attorney, Agent, or Firm* — Getz Balich LLC

(57) ABSTRACT

Apparatus for gaining access to a well via a lateral access passage includes a flexible conduit which is to be inserted into the well via the lateral access passage so as to deviate from a direction of lateral insertion to a generally downward direction down the well. The flexible conduit includes a probe at a front end thereof. The probe includes a spring at least 0.5 m in length. A probe container is provided for accommodating the probe before it is inserted into the well. A guide may be provided for insertion along the lateral access passage and for assisting deviation of the flexible conduit from the direction of lateral insertion.

10 Claims, 24 Drawing Sheets

(51) Int. Cl.
*E21B 23/08* (2006.01)
*E21B 33/072* (2006.01)

(56) References Cited

U.S. PATENT DOCUMENTS

| | | | | |
|---|---|---|---|---|
| 6,220,372 | B1 * | 4/2001 | Cherry | E21B 7/061 166/117.5 |
| 2003/0106715 | A1 * | 6/2003 | Clemmons | E21B 7/046 175/19 |
| 2003/0132004 | A1 * | 7/2003 | Suro | E21B 33/062 166/380 |
| 2005/0109518 | A1 | 5/2005 | Blacklaw | |
| 2010/0319933 | A1 | 12/2010 | Baugh | |
| 2011/0079402 | A1 | 4/2011 | Darby et al. | |
| 2012/0241174 | A1 | 9/2012 | Langeteig | |

FOREIGN PATENT DOCUMENTS

| | | | |
|---|---|---|---|
| WO | WO 2011/071389 | A1 | 6/2011 |
| WO | WO 2014/076489 | A2 | 5/2014 |
| WO | WO 2017/129632 | A1 | 8/2017 |

OTHER PUBLICATIONS

UK Search Report of Application No. GB 1702936.4 dated May 2, 2017, 4 pages.
International Search Report of International Application No. PCT/EP2018/054601 dated Oct. 1, 2018, 7 pages.

* cited by examiner

WELL ACCESS APPARATUS AND METHOD

The present invention relates to apparatus and methods for gaining access to a well.

Wells created for oil and gas production often have at least one lateral access passage which provides for communication between the inside of the well and the outside. The lateral access passage may consist of a side opening in a well wall, together with a passageway radially outwardly of the side opening. The radially outer passageway extends through a valve projecting radially from the well wall. The valve may be opened to allow communication between the side wall and further radially outward components.

Sometimes it is desired to access the inside of wells in order to remove blockages or carry out other well intervention operations. For this purpose a lateral access passage may be used to insert an intervention conduit, such as a coiled tubing or a hose, which is then required to be conveyed down the well.

It is known from WO 2011/071389 to provide an injection module for lateral insertion and bending of a steel coiled tubing via a lateral access passage of a well. The injection module connects to the lateral access passage via a flanged connection. The injection module includes an insertion device which is driven forwardly by injection equipment from an initial position rearwardly (or radially outwardly with respect to the well) of the lateral access passage to an inserted position in which a forward end of the insertion device extends out of the lateral access passage and into a well annulus. The insertion device has an internal guide conduit along which a coiled tubing may be driven forwardly by a conveyor device. The guide conduit has a curved portion at its front end whereby it deviates from a horizontal orientation to a downwardly vertical orientation, so that as the coiled tubing is driven forwardly it is bent from a horizontal direction of travel to a downwardly vertical direction. Because of the limited space available for bending the coiled tubing the bending radius is small and the coiled tubing is plastically deformed. The guide conduit also has a straight portion forwardly of the curved portion for straightening the plastically deformed coiled tubing so that it may continue forwardly and down the well as it is driven by the conveyor device. However, it can be difficult to achieve consistent straightening so that the coiled tubing may have a tendency to deviate from the downward direction as it is conveyed forwardly and this may limit the depth down the well which the coiled tubing reaches.

Another approach to accessing a well is to use an intervention hose, usually made of a steel reinforced polymer, which is more flexible than steel coiled tubing and generally is not subject to plastic deformation when being bent from an initial horizontal orientation to a downwardly vertical orientation. It is known from WO 2010/014326 to provide a drive assembly for inserting a hose into a well via a lateral access passage. In this document it is proposed to provide a polymeric insert which is inserted into the lateral access passage at its forward end, the insert being placed on the bottom part of the passage and having a curved upper face intended to guide the hose from the horizontal to the vertical orientation as it is driven into the well. This may serve to protect the bottom surface of the hose from a relatively sharp edge at the forward end of the lateral access passage as the hose bends from horizontal to vertical.

WO 2010/014326 also discloses a weight assembly at the forward end of the hose. The weight assembly comprises multiple articulated elements which allow it to deviate from horizontal to vertical at the front end of the lateral access passage as the hose is initially driven forwardly.

Viewed from one aspect the invention provides apparatus for gaining access to a well via a lateral access passage, comprising a flexible conduit which is to be inserted into the well via the lateral access passage so as to deviate from a direction of lateral insertion to a generally downward direction down the well, the flexible conduit comprising a probe at a front end thereof, the probe comprising a spring at least 0.5 m in length.

The invention also provides a method for gaining access to a well via a lateral access passage, comprising:

inserting a flexible conduit into the well via the lateral access passage so that the flexible conduit deviates from a direction of lateral insertion to a generally downward direction down the well, the flexible conduit comprising a probe at a front end thereof, and the probe comprising a spring at least 0.5 m in length.

A probe comprising a spring can deviate from the direction of lateral insertion to the generally downward direction without plastic deformation. It can naturally restore itself to an un-deviated state. Thus it may be inherently self-straightening, without having to rely on gravitational forces provided by weights or heavy material in a chain or similar.

In confined spaces or those heavily contaminated by solid or viscous materials such as mud, the use of a probe comprising a spring can assist in meeting the challenge of penetration down a well. If the spring meets an obstruction whilst the flexible conduit is being inserted into the well it can deviate sideways to pass the obstruction and may then be self-straightening.

In one possible use of the apparatus, the probe may be rotated and the spring may then act like a corkscrew. This may assist vertical penetration in congested regions, such as those filled with old drilling mud. An opposite rotation may assist in pulling the probe free from such congested regions. Rotation may be effected by rotating the flexible conduit, so as to transmit torsion to the probe at its front end. If the flexible conduit is supported on a drum or the like, the drum may be carried in a gimbal type frame to permit such rotation.

The spring may be at least 1 or 2 or 3 or 4 or 5 or 10 or 20 or 50 or 100 or 200 m in length. The spring may have a length of up to 10 or 20 or 50 or 100 or 200 or 300 or 400 or 500 m. The spring may have a length in a range defined between any of the aforementioned minimum lengths and maximum lengths. One exemplary range is 5 to 50 m. The spring itself may act as a weight assisting pulling of the flexible conduit into the well. Longer lengths of spring will increase the amount of weight and so are able to assist with such pulling.

The spring can be used with or without an internal component, depending on the required function. Typical components could be, but are not limited to: a flexible hollow pressure containing conduit, a fibre-optic conduit, an electrical conduit, or optical or electrical sensors. The spring may have attached thereto various sensors, tools or hydraulically driven components as required. In one application, the flexible conduit is used for fluid circulation, such as to inject intervention fluids into a well, in which case a liquid containing conduit may be provided internally of the spring. However, this may not always be necessary as the spring itself may have a sufficient liquid carrying ability.

The flexible conduit may comprise a hose with the spring connected to a front end of the hose. Such a connection may comprise a connecting tube receiving the hose inside one end and receiving the spring inside the other end. An example of a connecting tube is a "Chinese finger", which may be soaked with an epoxy resin.

The spring may extend continuously substantially the full length of the probe. The spring may be a coil spring. The probe may be defined as that part of the flexible conduit extending forwardly of a connection between a front end of the hose and a rear end of the probe. The full length of the probe may then be the length between its rear end at the connection and its front end. The hose may be made of a polymeric material, with or without metallic reinforcement.

The apparatus may comprise a probe container for accommodating the probe before it is inserted into the well and whilst the probe is exposed to well pressure in the probe container. The probe container may provide an environment for accommodating the probe with complete pressure containment of the well pressure or annulus pressure. Appropriate seals may be provided at the front and rear ends of the probe container. The probe container may accommodate the probe with at least part of the probe extending along a curved path.

Viewed from another aspect the invention provides apparatus for gaining access to a well via a lateral access passage, comprising a flexible conduit which is to be inserted into the well via the lateral access passage, the flexible conduit comprising a probe at a front end thereof, and the apparatus comprising a probe container for accommodating the probe before it is inserted into the well and whilst the probe is exposed to well pressure in the probe container, the probe container accommodating the probe with at least part of the probe extending along a curved path.

The invention also provides a method for gaining access to a well via a lateral access passage, comprising:

connecting a probe container to the lateral access passage in a pressure tight manner, the probe container accommodating a probe at a front end of a flexible conduit with at least part of the probe extending along a curved path;

exposing the probe in the probe container to well pressure; and inserting the flexible conduit into the well via the probe container and the lateral access passage.

In this aspect of the invention, the probe may comprise a spring. The probe spring may extend continuously substantially the full length of the probe. The probe spring may be a coil spring.

By accommodating at least part of the probe extending along a curved path, the length of the probe can be contained in a relatively small space. Therefore, even probes of several metres in length can be accommodated without occupying too much space.

The probe container may provide an elongate chamber which itself follows a curved path. The curved path may extend for part of one revolution, or for one or more revolutions. The probe container may comprise a flexible tube, such as a pipe or hose, which may be pressurised by being exposed to the pressure of the well or well annulus. A flexible tube is well suited to accommodate the probe with at least part of the probe extending along a curved path. The probe container may be supported by being wound on a spool. This would enable the probe container to have a curved path extending for multiple revolutions. It therefore facilitates the accommodation of a relatively long probe in a small amount of space.

The apparatus may comprise a drive mechanism for advancing the probe container towards or along the lateral access passage. This may be of assistance if it is desired to provide a guide to assist in deviating the flexible conduit from a direction of lateral insertion to a generally downward direction, because by advancing the probe container forwardly such a guide can be positioned at a forward end of the lateral access passage where the deviation is to take place. Such a guide is discussed further below.

The forward advancement of the probe container may be over a certain stroke length, for example between 10 cm and 1 m. In general, the stroke length should be enough to advance a front end of the probe container along the lateral access passage. A support for the probe container, such as a spool as discussed above, may therefore be configured to accommodate movement of the probe container over the stroke length.

The drive mechanism may be configured to both advance the probe container forwardly and to retract it. A suitable drive mechanism is disclosed in WO 2011/071389.

Due to the probe container accommodating the probe with at least part of the probe extending along a curved path, there is some versatility concerning the positioning of the probe container relative to the well. If the probe did not follow a curved path it may not be possible to position it in a confined space immediately adjacent to the well and radially outwardly thereof. For example, if the probe container comprises a flexible hose this can be manipulated into a shape which copes with space restrictions, allowing different approach angles to the well and permitting a rear part of the probe container to be disposed at a distance from the well.

A seal may be provided around the probe container, i.e. a probe container seal. The seal may be configured to allow forward advancement of the probe container. In embodiments in which the probe container is configured to be forwardly advanced, for example by the drive mechanism, then the probe container seal can be of a stuffing box type, permitting forward and/or rearward movement of the probe container whilst maintaining the seal.

The probe container may comprise an insertion tube for forward advancement along the lateral access passage. The probe container seal may seal around the insertion tube. The insertion tube may be rigid. In the embodiments in which the probe container comprises a flexible tube, as discussed above, such a flexible tube may be connected to a rear of the insertion tube. The insertion tube and the flexible tube may be forwardly and/or rearwardly advanced together, for example over the stroke length.

The apparatus may comprise a seal around the flexible conduit which seals between the flexible conduit and an inner periphery of the probe container, i.e. a flexible conduit seal. Such a flexible conduit seal may be of a known stuffing box type. The flexible conduit seal may be located at the rear of the probe container.

The apparatus can be used to gain access to a well via a lateral access passage whilst providing a complete pressure containment of the well pressure or annulus pressure e.g. during an intervention. This can be achieved for example by a first seal around the probe container and a second seal around the flexible conduit, as discussed above. The first seal may be located forwardly of the second seal. The first seal may be provided at a forward end portion of the probe container and the second seal may be provided at a rearward end portion of the probe container.

An injector may be provided for driving the flexible conduit into the well, in general assisted by the weight of the probe as discussed above. The injector may be provided rearwardly of the probe container. The flexible conduit seal may be located forwardly of the injector.

The apparatus may comprise a guide for insertion along the lateral access passage and for assisting deviation of the flexible conduit from a direction of lateral insertion to a generally downward direction, the guide being resiliently biased so that when a forward end portion thereof extends out of the lateral access passage into the well, the resilient bias causes the forward end portion to be directed at least partly downwardly in the well.

Viewed from another aspect the invention provides apparatus for gaining access to a well via a lateral access passage, comprising a flexible conduit which is to be inserted into the well via the lateral access passage, and a guide for insertion along the lateral access passage and for assisting deviation of the flexible conduit from a direction of lateral insertion, the guide being resiliently biased so that when a forward end portion thereof extends out of the lateral access passage into the well, the resilient bias causes the forward end portion to be directed in a direction different from the direction of lateral insertion.

The invention also provides a method for gaining access to a well via a lateral access passage, comprising:

inserting a guide along the lateral access passage in a direction of lateral insertion, the guide being resiliently biased so that when a forward end portion thereof extends out of the lateral access passage into the well, the resilient bias causes the forward end portion to be directed in a direction different from the direction of lateral insertion; and inserting a flexible conduit into the well via the lateral access passage in the direction of lateral insertion, with the guide assisting deviation of the flexible conduit from the direction of lateral insertion.

In this aspect of the invention the flexible conduit may comprise a probe at a front end thereof, the probe comprising a spring. The probe spring may extend continuously substantially the full length of the probe. The probe spring may be a coil spring.

The different direction may be an at least partly downward direction. The guide may thus assist deviation of the flexible conduit from the direction of lateral insertion to the generally downward direction.

The guide may comprise an engagement member for engaging a radially outer surface of a downwardly extending inner wall of the well, such as the wall of a well casing, casing hanger, production tubing or tubing hanger, to assist in restricting movement of the guide in a circumferential direction of the radially outer surface. By restricting such movement the forward end portion of the guide may be assisted in being directed in the at least partly downward direction.

The different direction may be an at least partly circumferential direction with respect to the well. This may be desirable if it is intended that a front end of the flexible conduit be deviated around a well annulus radially internally of the lateral access passage. It may be desired to deliver fluid via the flexible conduit into the well annulus at a location circumferentially spaced from the lateral access passage. Such fluid may for example be a sealant which is to be used to repair a seal between radially inner and outer well components, such as between a well casing and an inside surface of a well outer wall, or between a production tubing and the outer wall. The sealant may be formulated to have a density such that it floats or sinks depending on where it is desired for it to lodge. The front end of the flexible conduit may be advanced substantially all the way round the well annulus and then may be withdrawn while discharging fluid, so as to distribute the fluid substantially all the way round the annulus.

The apparatus may comprise a nozzle at the front end of the flexible conduit. This can be used to deliver fluid, for example to deliver sealant into a well annulus. A front end of the flexible conduit, such as a nozzle, may have a convex front surface. This can assist in helping the flexible conduit to move around a well annulus after it has been deviated to an at least partly circumferential direction.

In embodiments, in an initial position the guide may be held within a portion of the apparatus itself, such as a guide chamber or passage leading to the lateral access passage of the well. At this time it may be constrained to be in a generally straightened shape, against the resilient bias. Such constraint may also be provided by the lateral access passage as the guide is inserted therealong. However, once the forward end portion of the guide extends out of the lateral access passage at its forward end (or with respect to the well geometry, at the radially inner end of the lateral access passage), the resilient bias causes the forward end portion to be directed in a direction different from the direction of lateral insertion. If the resilient bias is such that the natural state of the guide is to curve through a 90° bend, it may adopt a state in which its forward end points perpendicularly to the direction of lateral insertion. For example, if the direction of lateral insertion is a horizontal direction (e.g. a radial direction with respect to a well), then with further forward advancement of the guide, it may adopt a state in which its forward end points vertically downwardly, or a state in which its forward end points circumferentially with respect to a well annulus.

The guide may be considered as having a first profile when it is in a guide chamber or passage leading to the lateral access passage of the well, such first profile being viewed in the direction of lateral insertion. It may be constrained to this first profile, against its resilient bias. However, once the guide extends at least partly out of the lateral access passage, it may then occupy a second profile as viewed in the direction of lateral insertion, which extends outside the first profile as viewed in that direction. It may therefore then extend outside a profile of the lateral access passage as viewed in the direction of lateral insertion. As the guide will normally form a curved path when its forward end portion extends out of the lateral access passage into the well, some of the curved path may lie in the profile of the lateral access passage and some of the curved path may lie outside that profile. Thus the radius of curvature followed by the flexible conduit when its direction is deviated by the guide may be larger compared to a situation where the flexible conduit simply bends around a radially inner edge of the lateral access passage. This may limit the degree of bending required by the flexible conduit to achieve deviation of its direction.

The guide may comprise a coil spring. The flexible conduit may be guided along a hollow portion inside the coil spring.

Viewed from a further aspect the invention provides apparatus for gaining access to a well via a lateral access passage, comprising a head portion configured to be inserted into the lateral access passage and to guide a flexible conduit into the well, and a cutting blade configured to cut the flexible conduit when it extends into the well.

The invention also provides a method for gaining access to a well via a lateral access passage, comprising:

inserting a head portion into the lateral access passage;

guiding a flexible conduit into the well along the head portion; and cutting the flexible conduit or a component attached to the flexible conduit with a cutting blade when the flexible conduit or the component extends into the well.

If a problem arises with the flexible conduit in the well, or if e.g. a well intervention job has been completed and there is no need to recover the flexible conduit from the well, this aspect of the invention provides for the cutting of the flexible conduit when it extends into the well, for example into a well annulus.

The flexible conduit rearwardly of the cut may be retracted from the lateral access passage, and the head portion may also be retracted. In the usual case where a gate valve of the well has been opened to allow access via the lateral access passage, this gate valve can be closed after such retraction. There is therefore no need to provide an additional valve outwardly of the well, such as a valve of a blowout preventer, which would occupy space outwardly of the well. In many well intervention operations, the available space outwardly of the well is very limited.

The flexible conduit may have at least one component attached to it, such as a nozzle or other tool, and it may be desired or necessary to cut through such a component rather than through the flexible conduit.

The cutting blade may be arranged to cooperate with the head portion.

The cutting blade may be at least partly supported by the head portion.

The cutting blade may extend forwardly in the direction of lateral insertion. It may extend forwardly from a location rearwardly of the head portion and along its length.

The cutting blade may be forwardly movable relative to a front part of the head portion to effect cutting.

The cutting blade and the head portion will normally be configured so that the cutting blade cuts the flexible portion when the head portion is disposed in the lateral access passage. The cutting blade and the head portion may be configured so that the cutting blade cuts the flexible portion forwardly of the lateral access passage, i.e. in the well, for example in the well annulus.

The head portion may comprise a cutting surface opposed to the cutting blade, whereby during cutting of the flexible conduit the cutting blade cuts through the flexible conduit as the cutting blade is advanced towards the cutting surface. The cutting surface may provide an abutment for the flexible conduit to hold it in place when it is being cut. The cutting surface may be engaged by the cutting blade on completion of the cut. The cutting surface may be provided as a rearwardly facing surface on the front part of the head portion.

The apparatus may comprise a resilient device configured to compress in the direction of lateral insertion of the head portion during cutting of the flexible conduit.

The resilient device may allow the cutting blade to advance relative to a main body of the head portion. The main body may be prevented from further advancement by engagement with a portion of the well, such as a radially inner surface of a well annulus.

The resilient device may be configured to compress when the front part of the head portion is prevented from further advancement by engagement with a portion of the well, such as a radially inner surface of a well annulus.

The resilient device may comprise a spring, e.g. a compression spring, acting between a support for the cutting blade and the front part of the head portion. The apparatus may be configured so that when it is desired to cut the flexible conduit, the support is advanced in the direction of lateral insertion, the front part of the head portion being prevented from further advancement by engagement with a portion of the well, such as a radially inner surface of a well annulus, and the spring then compressing to allow the support and the cutting blade to advance relative to the front part of the head portion and thereby cut the flexible conduit. At this time, the flexible conduit may be disposed between the front part of the head portion and the cutting blade. The cutting surface described above may be provided as a rearwardly facing surface on the front part of the head portion.

The resilient device may comprise a resilient body supporting the cutting blade. The resilient body may have a front engagement portion for engagement with the flexible conduit. The apparatus may be configured so that when it is desired to cut the flexible conduit, a rear part of the resilient body is forwardly advanced in the direction of lateral insertion and the front engagement portion is prevented from further advancement by engagement with the flexible conduit, the cutting blade then advancing forwardly of the front engagement portion to cut the flexible conduit.

Viewed from another aspect, the invention provides apparatus for gaining access to a well via a lateral access passage, comprising a flexible conduit which is to be inserted into the well via the lateral access passage, and a guide for insertion along the lateral access passage at least partly into the well and for assisting deviation of the flexible conduit from a direction of lateral insertion towards a downward direction, the guide comprising a first guide surface for engagement with a leading front tip of the flexible conduit during insertion thereof into the well to initiate said deviation of the flexible conduit from the direction of lateral insertion towards the downward direction, and a second guide surface for supporting and guiding the flexible conduit from below.

The invention also provides a method for gaining access to a well via a lateral access passage, comprising:

inserting a guide along the lateral access passage in a direction of lateral insertion so that the guide extends at least partly into the well, the guide comprising a first guide surface and the guide comprising a second guide surface for supporting and guiding the flexible conduit from below; and inserting a flexible conduit into the well via the lateral access passage in the direction of lateral insertion, such that a leading front tip of the flexible conduit engages the first guide surface of the guide to initiate deviation of the flexible conduit from the direction of lateral insertion towards a downward direction.

In use, because separate first and second guide surfaces are provided, as the leading front tip of the flexible conduit is urged downwardly during insertion of the flexible conduit into the well, it can do so without frictional interaction of the leading front tip with the second guide surface. This is unlike known guide conduits, such as that of WO 2011/071389 or US 2010/319933, in which a guide conduit of circular cross-section is provided and so restricts the flexible conduit all the way round its circumferential periphery. Thus the required force for insertion of the flexible conduit may be reduced.

The first guide surface may be located forwardly of the second guide surface in the direction of lateral insertion. Thus, the initial engagement by the leading front tip may be at a location on the first guide surface which is located forwardly of the second guide surface in the direction of lateral insertion. When the leading front tip of the flexible conduit is urged downwardly during insertion of the flexible conduit into the well, the deflection of the leading front tip by the first guide surface can occur by contact of the top part of the leading front tip with the first guide surface, without the bottom part of the leading front tip being in contact with the second guide surface.

When the flexible conduit is advanced forwardly, it may project in cantilever fashion into a space rearwardly adjacent to the first guide surface before being downwardly deflected by contact with that first guide surface. Thus frictional interaction of the flexible conduit with the second guide surface during the deviation of the flexible conduit from the direction of lateral insertion to the downward direction may be avoided.

The flexible conduit may adopt a radius of curvature as determined by the available space, rather than determined by a circular cross-sectional guide conduit having a fixed radius of curvature.

The second guide surface may be such as to curve downwardly from the direction of lateral insertion. It may be open topped, at least where it curves downwardly. Thus the second guide surface can be configured to avoid constraining the flexible conduit from above. This can help to reduce any frictional losses as the flexible conduit moves forwardly or rearwardly. Such an open topped second guide surface may have no sides, or it may be in the form of a channel.

In some embodiments the first guide surface may be approximately 2-3 flexible conduit diameters forwardly of the second guide surface.

For a first part of its downward travel into the well, the flexible conduit may not engage the second guide surface. As the flexible conduit is inserted further into the well its weight will normally tend to cause the flexible conduit to engage the second guide surface, so that the radius of curvature at this stage will be reduced compared to during the first part of the downward travel. However, at this stage the flexible conduit will normally not engage the first guide surface, again tending to reduce frictional resistance.

The flexible conduit may comprise a spring at a front end thereof. As with the other aspects of the invention, the flexible conduit may comprise a probe at a front end thereof, the probe comprising a spring. A spring is particularly well-suited to have its leading front tip engage with the first guide surface to initiate deviation of the flexible conduit from the direction of lateral insertion towards the downward direction. In embodiments, the spring naturally adopts a straight longitudinal shape, so that once the spring has gone past the first guide surface it will automatically straighten itself to progress downwardly into the well.

The guide may comprise a first guide part on which the first guide surface is provided, and a second guide part on which the second guide surface is provided, the first guide part and the second guide part being longitudinally movable relative to each other in the direction of lateral insertion. This may be beneficial to adjust the spacing between the first and second guide surfaces depending on the diameter of the flexible conduit, and/or its stiffness.

The relative movement of the first and second guide parts may also provide for deployment of a guide tongue, which may form at least part of the second guide surface. The guide tongue may displace from an upper position within the profile of the lateral access passage as viewed in the direction of lateral insertion, to a lower position in which it extends downwardly outside of that profile. This displacement may occur when the first and second guide parts are moved relative to each other, by removing a constraint holding the guide tongue in the upper position.

By providing a guide tongue in this way, it is possible to provide an increased radius of curvature between the direction of lateral insertion and a downward direction, compared to when all of that curvature is provided within the profile of the lateral access passage as viewed in the direction of lateral insertion. This radius of curvature is generally applicable when the weight of the flexible conduit is causing it to engage with the second guide surface.

The relative movement of the first and second guide parts may also be useful for cutting the flexible conduit as described in relation to the relevant aspect of the invention above. The cutting blade may be fixed in the direction of lateral insertion with respect to one of the guide parts, for example the second guide part, and the cutting surface may be fixed in the direction of lateral insertion your with respect to the other of the guide parts, for example the first guide part.

The first and second guide parts may be telescopically arranged with respect to each other to provide said relative longitudinal movement.

The first guide part may be disposed radially outwardly of the second guide part.

The first guide part may be provided by the insertion tube as described elsewhere herein, with the first guide surface being provided on the insertion tube. The second guide part may be provided by the front guide device as described elsewhere herein, with the second guide surface being provided on the front guide device.

The invention in its various aspects is suitable for application in the oil and gas industry and in particular to oil or gas production wells or injection wells.

The lateral access passage will generally be to a wellhead or a production tree. It may be at an angle to the horizontal, or it may extend horizontally. The lateral access passage may be through an annulus wing of a wellhead, or a service or kill wing of a production tree.

The flexible conduit may be used for well intervention operations, such as to remove blockages, create blockages, or conduct a sealing operation. Thus the flexible conduit may be a well intervention conduit.

Certain preferred embodiments of the invention will now be described, by way of example only, with reference to the accompanying drawings in which:

FIGS. 20A to 20L are respective schematic views of the third embodiment, showing the apparatus at different stages of its operation.

Figure 1:
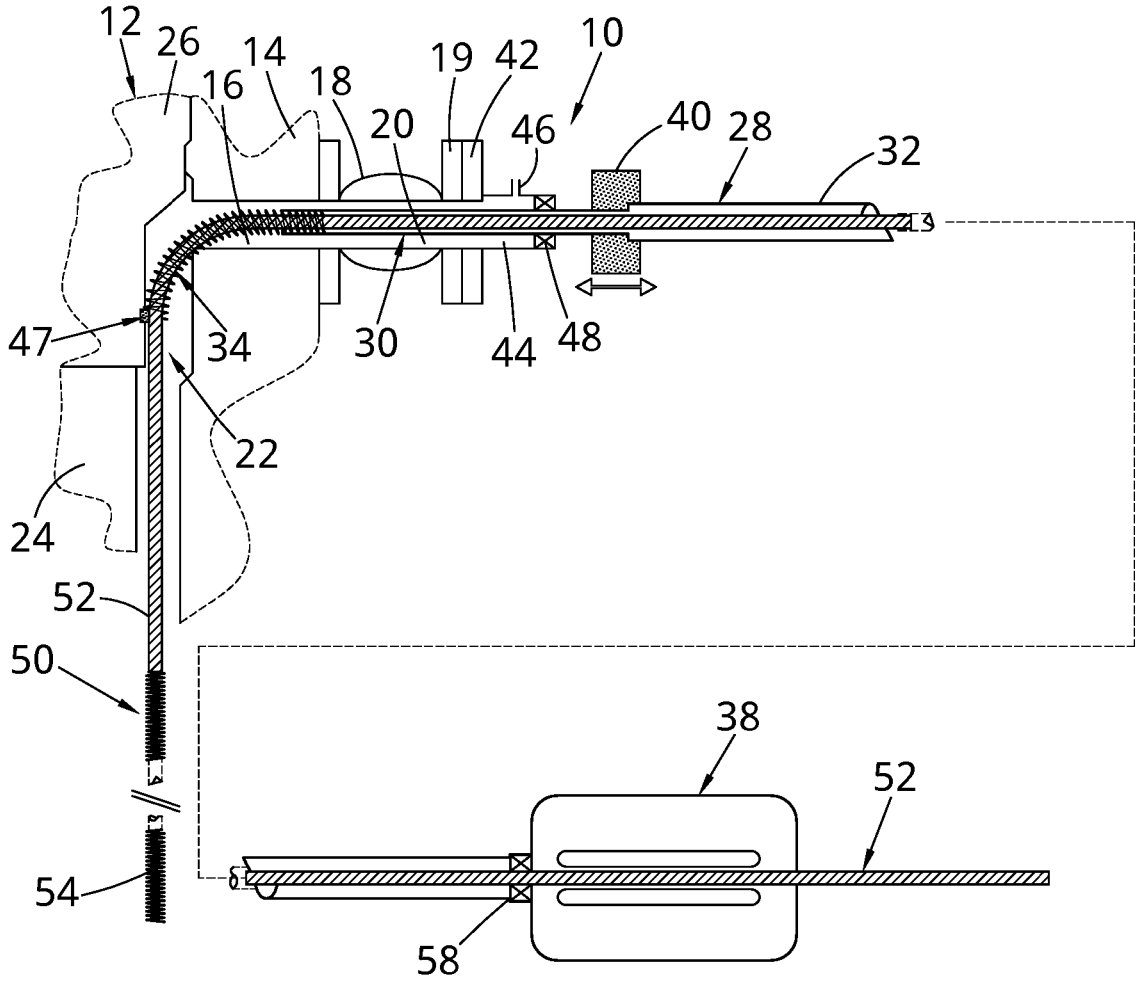
FIG. 1 is a schematic sectional view showing an embodiment of the apparatus in accordance with the present invention connected to a well head.

FIG. 1 shows apparatus 10 connected to a wellhead 12. The wellhead has an annular outer wall 14 formed with a side opening 16 and a valve 18 having therethrough a passageway 20 which is aligned with the side opening 16 in the outer wall 14.

The passageway 20 and the side opening 16 together form a lateral access passage, which provides access to the outside of the outer wall 14, the inside of the side opening 16, or the space radially inwardly of the side opening.

The valve 18 has a radially outer flange 19. The wellhead 12 has an annular cavity 22, known as the annulus, between a radially outer surface of a well casing 24 and an inside surface of the outer wall 14. The well casing 24 is supported by a casing hanger 26 which is in sealed engagement with the inside surface of the outer wall 14.

The wellhead 12 is of a standard construction. The valve 18 is normally a gate valve, which when closed shuts off access from the outside to the wellhead side opening 16.

In this embodiment, the apparatus 10 is shown being used to gain access to the annular cavity 22 between the radially outer surface of the well casing 24 and the inside surface of the outer wall 14. In another use of the apparatus 10, it may gain access to an annulus between a radially outer surface of a production tubing and an outer wall. Such a production tubing may hang from a tubing hanger which is in sealed engagement with the inside surface of the outer wall.

The apparatus 10 for gaining access to the well via the lateral access passage will now be described. The apparatus comprises a probe container 28 having an insertion tube 30, which may be rigid, and connected to the rear of the insertion tube 30, a flexible tube 32. At the front end of the insertion tube 30 a guide in the form of a guide spring 34 is provided. In this embodiment the guide spring is a coil spring. The insertion tube 30 is connected at its rear end in pressure tight manner to a front end of the flexible tube 32. The flexible tube 32 may be a pipe or hose which may be pressurised, by being exposed to the pressure of the annulus 22, and which may also extend along a curved path. In the embodiment shown in FIGS. 6 to 9, the probe container 28 is coiled on a probe container drum or spool 36. At its rear end the probe container 28 is connected in pressure tight manner to an injector 38. The injector 38 may be of a known type for forwardly driving or injecting a hose into a well, such as described in U.S. Pat. No. 6,186,239 for example.

The probe container 28 comprising the insertion tube 30 and the flexible tube 32 are together axially forwardly and rearwardly movable by a drive mechanism 40. This may be of a known type, such as that described in WO 2011/071389. The drive mechanism is configured to advance the probe container 28 from a rear position as shown in FIG. 1 over a certain stroke length to a forward position. In the embodiment of FIGS. 6-9, the probe container 28 is shown in a rearward position in FIG. 6 and a forward position in FIG. 9.

At its forward end, i.e. its radially inner end with respect to the wellhead, the apparatus 10 has a flange 42 for making a sealed and bolted connection (neither the bolts nor the seal are shown) to the radially outer flange 19 of the wellhead valve 18. Rearwardly of the flange 42, the apparatus has a guide chamber 44 which includes a return outlet 46 for allowing fluid displaced from the well annulus to exit from the apparatus. A probe container seal 48 at the rear of the guide chamber 44 seals around the insertion tube 30 of the probe container 28. The seal is of a conventional stuffing box type and allows the insertion tube to reciprocate forwardly and rearwardly whilst maintaining a pressure tight barrier between the inside of the guide chamber 44, which itself is exposed to the pressure of the well annulus 22, and atmosphere.

Figure 6:
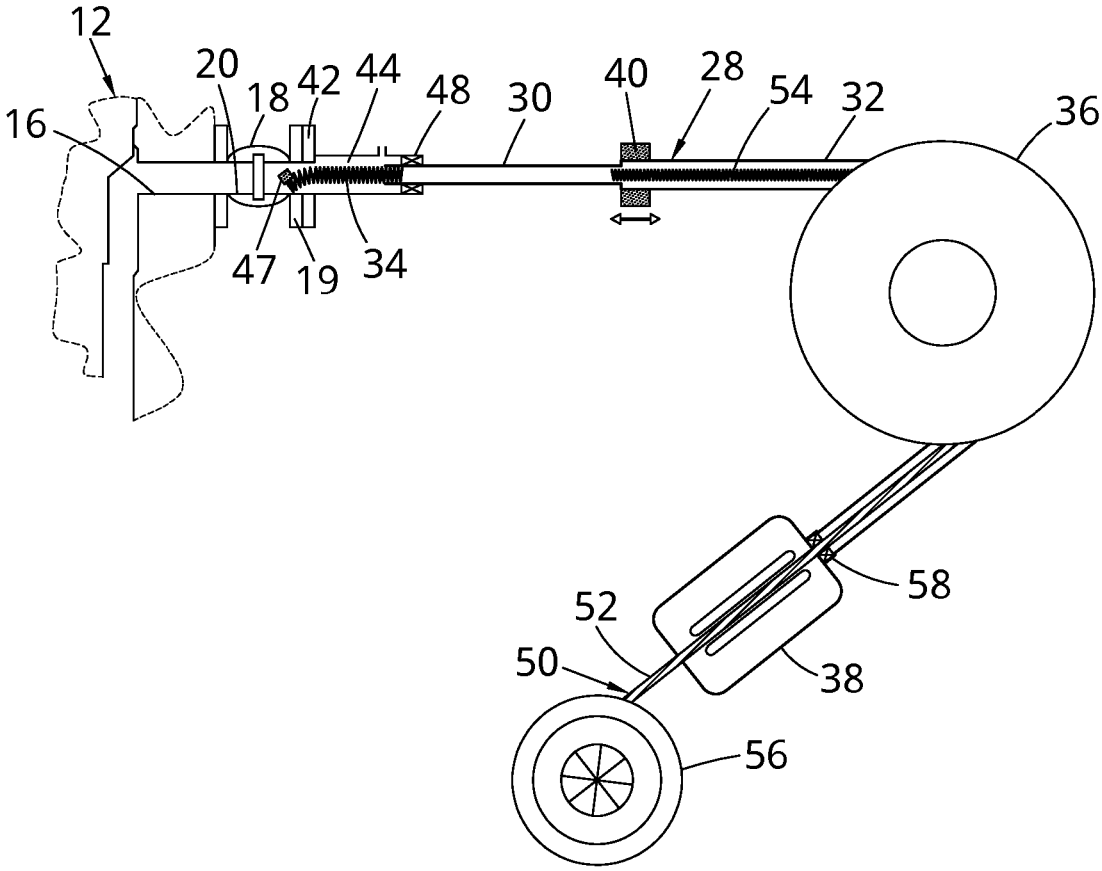
FIGS. 6 to 9 are respective schematic sectional views, similar to FIG. 1, showing the apparatus at different stages of its operation.
Figure 9:
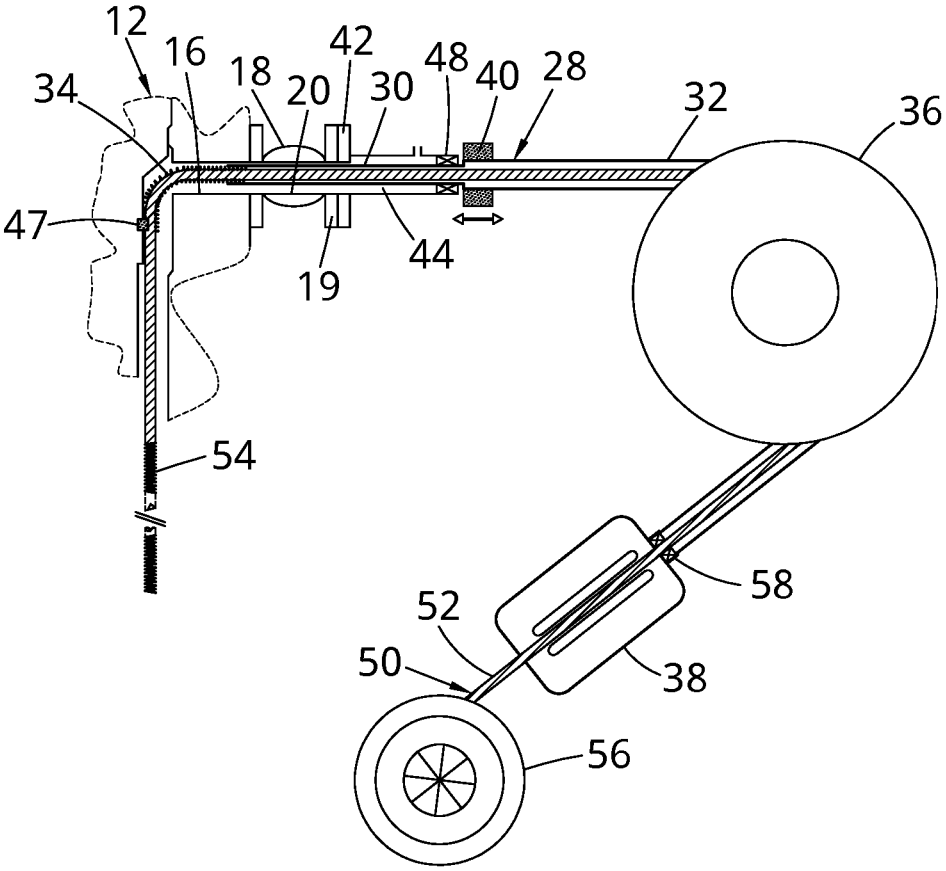

The natural, unstressed state of the guide spring 34 is for it to define a curved path, curving through 90°, as seen in FIG. 1 or FIG. 9. Thus it is resiliently biased to adopt such a curved shape, and is able to do so when the probe container is in the forward position. As seen in the embodiment of FIG. 6, when the probe container 28 is in the rear position, the guide spring 34 is constrained in the guide chamber 44 so as to be in a generally straightened state.

Figure 2:
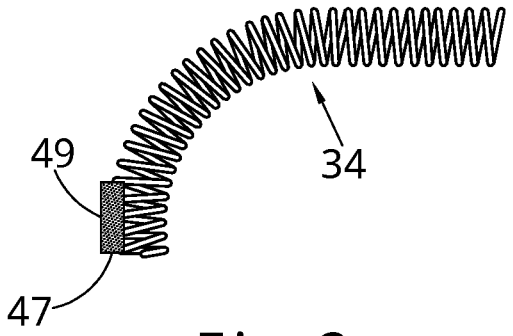
FIG. 2 is a side view of a guide of the apparatus.
Figure 3:
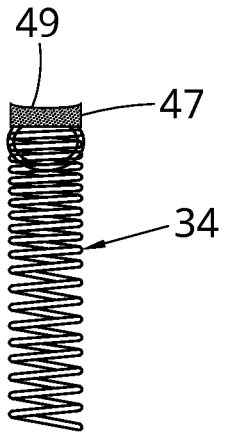
FIG. 3 is a top plan view of the guide of FIG. 2.

FIGS. 2 and 3 show views of the guide spring 34 when the probe container is in the forward position. An engagement member 47 is attached to a front portion of the guide spring 34, on its upper surface when the guide spring 34 is constrained by the guide chamber 44 as seen in FIG. 6, which becomes its radially inner surface with respect to the wellhead when the guide spring 34 emerges from the side opening 16 in the annular outer wall 14 of the wellhead. The purpose of the engagement member 47 is to engage a radially outer surface of the casing hanger 26 to assist in restricting movement of the guide spring 34 in a circumferential direction of the radially outer surface. The engagement member 47 has a concave surface 49 for matching with the radially outer surface of the casing hanger 26. The concave surface 49 is provided on a radially outer periphery of the guide spring 34, and faces radially outwardly with respect to the guide spring 34.

A flexible conduit 50 comprises a hose 52 and, at a front end of the hose 52, a probe in the form of a downhole spring 54. The hose is carried on a hose drum 56 (see FIGS. 6-9) and extends forwardly therefrom through the injector 38. A flexible conduit seal 58 located forwardly of the injector 38 seals around the hose 52. The seal is of a conventional stuffing box type and allows the hose to be driven forwardly whilst maintaining a pressure tight barrier between the inside of the probe container, which is exposed to the pressure of the well annulus 22, and atmosphere.

Figure 4:
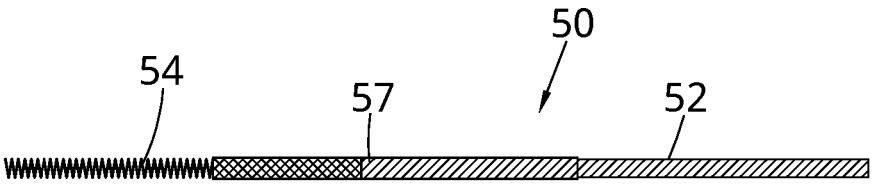
FIG. 4 is a side view showing a connection between a hose and a probe.
Figure 5:
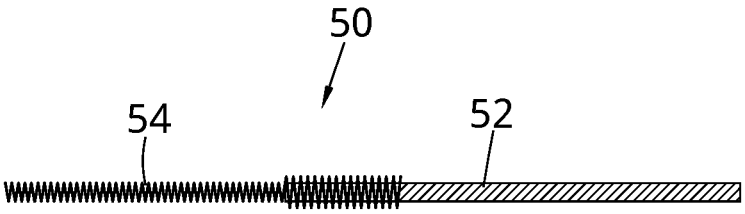
FIG. 5 is a side view showing an alternative type of connection between a hose and a probe.

FIGS. 4 and 5 respectively show two possible types of connection between the hose 52 and the downhole spring 54. FIG. 4 shows a "Chinese finger" tube 57 with the downhole spring 54 inserted into one end and the hose 52 inserted into the other end. Before assembly, the tube 57 is soaked in an epoxy glue. The spring 54 and the hose 52 are then inserted until they about one another and they are then pulled back slightly to cause the tube 57 to grip on the spring and the hose, where after the glue is allowed to set.

An alternative connection between the hose 52 and the spring 54 is shown in FIG. 5. In this case an end portion of the hose 52 fits inside an end portion of the spring and the natural resilience of the spring squeezes on the outside of the hose and forms a locking connection. During assembly of this connection, the spring is gripped approximately 15 cm from its end and then the end is twisted against the spring's direction of twist in order to increase the spring's internal diameter. The end portion of the hose is inserted into the expanded end portion of the spring, and the spring tension is released by turning its end in the spring's direction of twist, thereby reducing the internal diameter in a controlled manner. Thus a locked connection is formed.

The process of gaining access to a well via the lateral access passage will be described with reference to FIGS. 6-9. FIG. 6 shows the apparatus with the probe container 28 in the rear position and the hose 52 of the flexible conduit 50 wound on the hose drum 56. The probe in the form of the downhole spring 54 is contained in the flexible tube 32 of the probe container 28 and so the flexible tube 32 and the spring 54 are together wound on the probe container spool 36. The inside of the probe container 28 extending from the insertion tube 30 rearwardly to the flexible conduit seal 58 is subject to well annulus pressure. This is ensured by the probe container seal 48 at the rear of the guide chamber 44 sealing around the insertion tube 30 of the probe container 28, and the flexible conduit seal 58 located forwardly of the injector 38 which seals around the hose 52. It is to be noted that the downhole spring 54 does not extend through the flexible conduit seal 58. The flexible conduit seal 58 can thus seal against the relatively smooth surface of the hose 52, rather than against an undulating surface of the coiled downhole spring 54.

The downhole spring may have a length of many metres, for example up to 50 m or more, whilst being contained in the probe container 28 coiled around the probe container spool 36, and whilst being in a sealed and pressurised environment. By containing the downhole spring 54 with at least part of its length extending along a curved path (in this embodiment being coiled inside the probe container 28 around the probe container spool 36), a desired length of downhole spring may be used without occupying a large space. A long length of the downhole spring enables it to have a large weight which greatly assists insertion of the flexible conduit into the well.

As seen in FIG. 6, the guide spring 34 is constrained in the guide chamber 44 so that it is generally straight over most of its length. At this stage it is held in that state against its own resilient bias.

FIG. 6 also shows the valve 18 in a closed condition. The guide spring 34 protrudes a small amount into the passageway 20 of the valve. Once the flange 42 of the apparatus 10 has been secured in pressure tight manner to the flange 19 of the wellhead, i.e. the state shown in FIG. 6, the valve 18 is opened, allowing the inside of the guide chamber 44 and the probe container 28 to be exposed to the pressure in the well annulus, the drive mechanism 40 is operated to advance the probe container 28 forwardly, thereby forwardly advancing the insertion tube 30 of the probe container through the probe container seal 48, to the forward position shown in FIG. 7. During this advancement the guide spring 34 moves along the lateral access passage comprising the passageway 20 of the valve and the side opening 16 in the annular outer wall 14, whilst the lateral access passage continues to constrain the guide spring 34 in its generally straightened state. Once the front end of the guide spring 34 emerges from the lateral access passage into the annulus 22 its front end portion adopts a downwardly curved condition, caused by the spring tending towards its natural, unstressed state. During this process, the concave surface 49 of the engagement member 47 engages the radially outer surface of the casing hanger 26 and this helps to prevent the guide spring from moving in the circumferential direction of the annulus.

Figure 7:
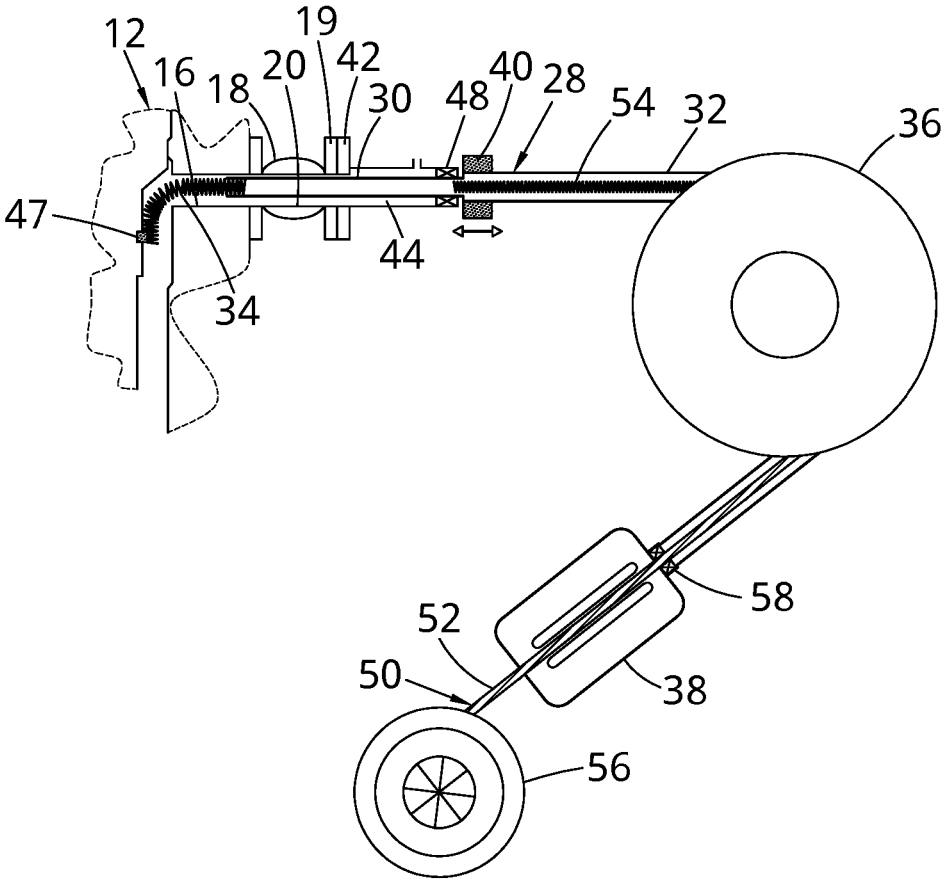
Figure 8:
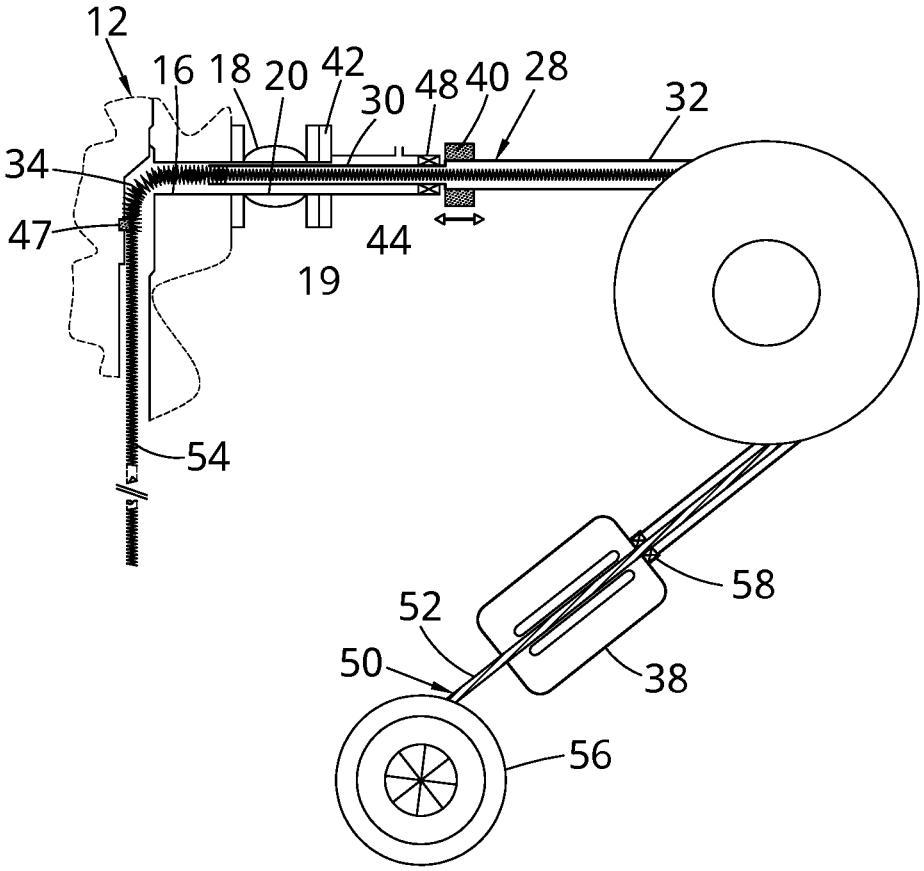

Once the probe container 28 and the guide spring 34 have been advanced forwardly to the forward position shown in FIG. 7, the flexible conduit 50 may be driven forwardly through the flexible conduit seal 58 by the injector 38. The downhole spring 54 at the front end of the hose 52 advances from the position shown in FIG. 7 along the insertion tube 30 and then along the guide spring 34, which deviates it from a generally horizontal orientation to a vertically downward orientation, as seen in FIG. 8. As the insertion process continues the length of the downhole spring 54 hanging in the well annulus 22 increases and the weight of the downhole spring 54 in the annulus increases correspondingly, thereby assisting with further forward advancement of the flexible conduit 50.

FIG. 9 shows the situation when a rear end of the downhole spring 54 has passed the front of the guide spring 34, with the entire length of the probe container 28 being occupied by the hose 52. After this stage, forward advancement of the hose 52 may continue under the weight of the downhole spring and its own weight and aided if necessary by the injector 38. When the front end of the downhole spring reaches a desired position it may perform different tasks. These include, but are not limited to, fluid circulation or holding one or more logging sensors at desired locations.

When it is desired to remove the flexible conduit 50 from the well, the injector 38 may be operated in reverse to pull it up. The hose 52 is then wound onto the hose drum 56 and the downhole spring 54 is retracted back into the probe container 28 coiled on the probe container spool 36.

In the described embodiment, the probe is bent as it passes through the forwardly deployed guide spring 34. Because the probe comprises a spring it does not suffer plastic deformation during this bending, unlike coiled tubing. It does not undergo a permanent change in straightness and so does not need to be straightened after the bend. It automatically straightens itself. There is also no self-hardening which could result from plastic deformation.

If the probe encounters an obstacle as it descends down the well it can bend and once the orientation of its front end has altered sufficiently it may then bypass the obstacle. Once it has done so, it can self-straighten. In doing so it relies on its own resilience rather than its weight as would be the case with conventional articulated weights such as lumps of metal or heavy material in a chain. In a space blocked by mud and/or a small space the spring may thus bypass the obstruction where a chain would not be able to do so.

After a sufficient length of the probe has been run into the well its weight will contribute to a pull on the length of the flexible conduit above the probe The apparatus can provide a complete pressure containment of the well pressure or annulus pressure during an intervention. This is achieved by the probe comprising the downhole spring 54 being contained in the probe container 28 in a pressure tight manner, with the probe container being sealed from the outside at its forward end adjacent to the well and being sealed at its rear end. The seal at the forward end allows the insertion tube 30 of the probe container 28 to be advanced forwardly by the stroke length to advance the guide spring 34 along the lateral access passage, and to be retracted rearwardly after an operation has been completed, whilst maintaining sealing integrity. The seal at the rear and allows the flexible conduit to pass forwardly therethrough as the flexible conduit is run down the well, and rearwardly when it is pulled up again, whilst maintaining sealing integrity. The pressure containment system makes up a pressure-tight path for the downhole spring 54 to be guided towards and into the well.

The internal diameter and the curvature of the probe container 28 are suitable to allow the flexible conduit 50 comprising the hose 52 and the downhole spring 54 to be moved forwardly and rearwardly without getting locked or stuck due to buckling and/or excessive friction between the flexible conduit and the inside wall of the probe container 28.

A second embodiment of the apparatus will be described with reference to FIGS. 10 to 18.

Figure 10:
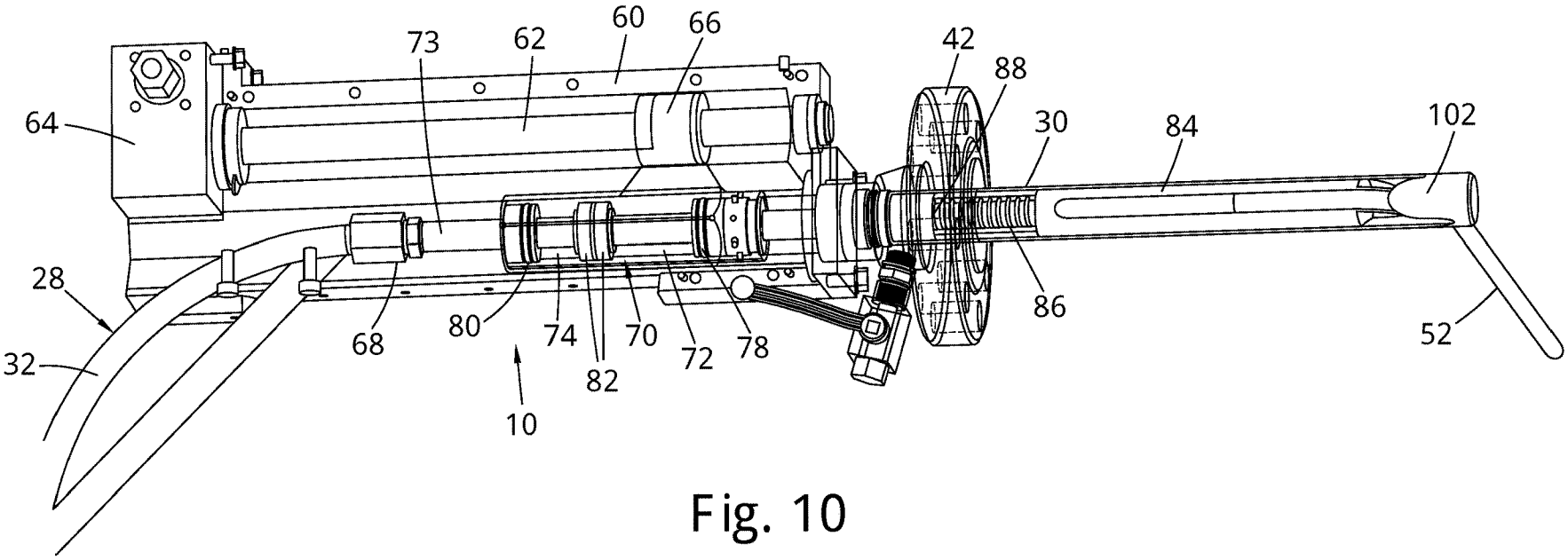
FIG. 10 is a perspective overview of a second embodiment with certain outer parts omitted to reveal the inner components.

FIG. 10 shows apparatus 10 for connection to a wellhead 12 in the same manner as for the first embodiment. At its forward end, i.e. its radially inner end with respect to the wellhead, the apparatus 10 has a flange 42 for making a sealed and bolted connection to the radially outer flange 19 of the wellhead valve 18, as seen in FIG. 1.

The apparatus is based on the tool described in W0 2017/129632, but modified to include aspects of the invention described herein. The apparatus has a housing 60 in which an output shaft 62 formed with an external screw thread (not shown) is arranged to be rotatably driven via a gearbox 64. An internally threaded nut 66 (corresponding to the nut 40 of W0 2017/129632) is mounted on the output shaft 62 and is prevented from rotation during rotational driving of the output shaft 62, so that when the output shaft is driven the nut 66 moves longitudinally forwardly or rearwardly, depending on the direction of rotation.

The apparatus is provided with a longitudinally extending chamber 68 in which a hydraulic unit 70 is longitudinally movable, forwardly or rearwardly. The hydraulic unit 70 is connected to the nut 66 so as to move longitudinally therewith.

A rear guide pipe 73 extends through the hydraulic unit 70. The hydraulic unit 70 has a cylindrical outer wall 76 in which are defined a front hydraulic chamber 72 and a rear hydraulic chamber 74. A front seal 78 and a rear seal 80 are provided between the rear guide pipe 73 and the cylindrical outer wall 76 of the hydraulic unit 70. The front and rear seals allow the rear guide pipe 73 to be longitudinally movable relative to the hydraulic unit 70 in sealing manner. A pair of intermediate seals 82 is provided between the rear guide pipe 73 and the cylindrical outer wall 76, separating the front and rear hydraulic chambers 72, 74.

At its rear end the rear guide pipe 73 is connected in sealed manner to a flexible tube 32 of a probe container 28, this flexible tube corresponding to the flexible tube 32 described in relation to the first embodiment. A hose 52, also corresponding to that described in relation to the first embodiment, extends inside the flexible tube 32 from the rear to the front of the apparatus 10. Only a portion of the hose 52 is shown in FIG. 10, supported by a head portion in the form of a front guide device 84 and protruding forwardly and downwardly therefrom. The front guide device 84 is to be inserted into a lateral access passage of the wellhead 12, and in FIG. 10 is shown in a forwardly advanced position.

The apparatus 10 has an insertion tube 30 of the probe container 28. A rear end of the insertion tube 30 is connected in sealed manner to the front of the hydraulic unit 70, so that when the nut 66 moves forwardly or rearwardly and causes the hydraulic unit 70 to move forwardly or rearwardly, the insertion tube 30 is also caused to move forwardly or rearwardly.

The front guide device 84 is longitudinally slidably disposed in the insertion tube 30. As can be seen in more detail in FIGS. 11 and 12, a spring 86 is seated on a seat 88 at the front end of the rear guide pipe 73 and extends forwardly to a connection with the front guide device 84. The spring 86 is sufficiently stiff to maintain the front guide device 84 in a forward position relative to the rear guide pipe 73 during advancement of these components towards and into the wellhead 12, but if forward movement of the front guide device 84 is resisted (as will be described later), the spring compresses to permit forward movement of the rear guide pipe 73 relative to the front guide device 84.

A pair of guide bars 90 (only one being visible in FIGS. 11 and 12) extends forwardly from the seat 88. A front end portion of each guide bar 90 is received in a respective slot 92 in a wall of the front guide device 84. Each front end portion engages a forwardly facing abutment 83 of the front guide device 84 under the force of the spring 86, limiting the front guide device 84 in its forward position relative to the rear guide pipe 73.

Figure 11:
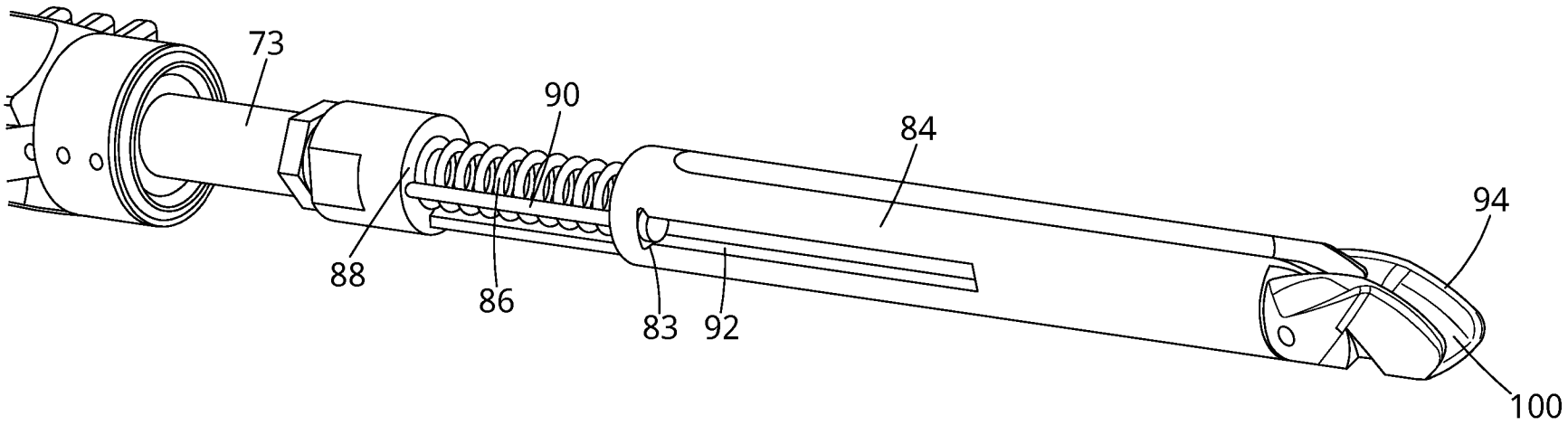
FIG. 11 is a perspective view of a front guide device and a rear guide pipe of the apparatus of FIG. 10.

The flexible conduit 50 extends forwardly inside the rear guide pipe 73 and actually along the middle of the spring 86 (not shown in FIGS. 10-11). The front guide device 84 comprises a longitudinally extending and upwardly facing channel 95 for guiding the hose 52 from a front end of the spring 86 towards the front of the front guide device 84. The channel 95 slopes upwardly from rear to front as it extends longitudinally. The channel 95 has a front portion 96 (see FIG. 13) where it curves downwardly. A pivotably mounted guide tongue 94 is provided at the front end of the front guide device 84. The guide tongue 94 is arranged so as to adopt an upper position when the front guide device 84 is being forwardly or rearwardly advanced along the lateral access passage, so that its profile when viewed in a direction of a lateral insertion is relatively confined and it is able to fit within the internal diameter of the insertion tube 30, which in turn can then have a sufficiently small external diameter to fit within the lateral access passage. The guide tongue 94 is shown in the upper position in FIGS. 11 and 12.

Figure 16:
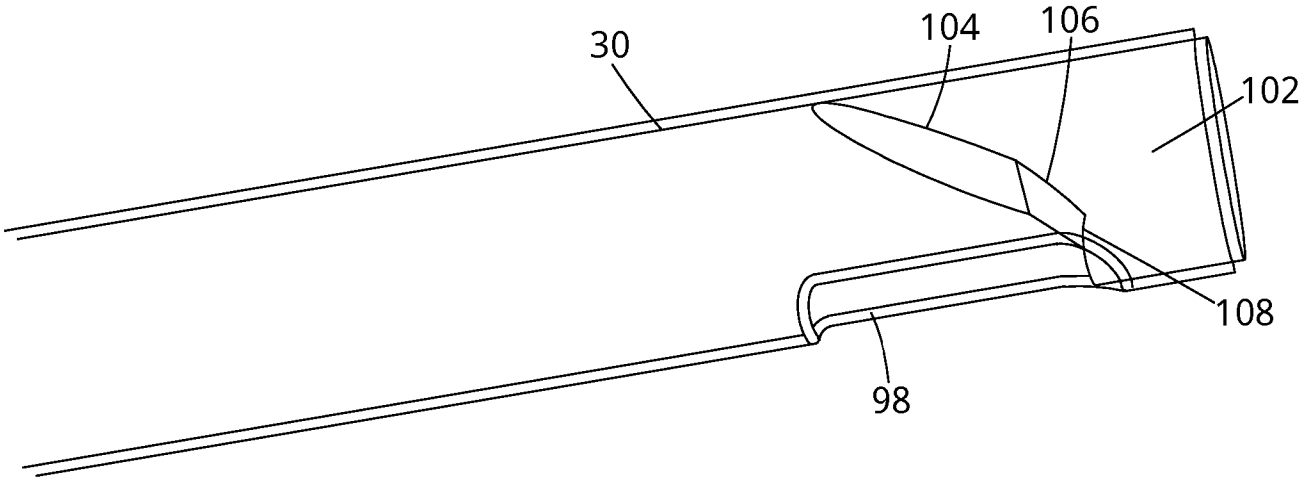
FIG. 16 is a perspective view showing the front part.

The insertion tube 30 has in its lower facing wall an opening 98 (see FIG. 16). The guide tongue 94 is arranged to drop under gravity to a lower position when it is advanced to a sufficiently forward position to emerge via the opening 98. The guide tongue 94 is shown in the lower position in FIG. 13. The guide tongue 94 has a guide tongue channel 100 which aligns with the curved front portion 96 of the channel 95 when the guide tongue is in its lower position.

As seen in FIGS. 10, 14, 15 and 16, the insertion tube 30 is provided at its front end with a deflection member 102 which assists in deviating the flexible conduit 50 from a direction of lateral insertion to a downward direction. The flexible conduit 50 may comprise a probe in the form of a downhole spring 54 as described in relation to the first embodiment. The deflection member 102 is fixed in the insertion tube 30. It has an upper face 104 at a first angle to the longitudinal direction, an intermediate face 106 at a second angle, and a lower face 108 at a third angle. In this embodiment the first angle is 30°, the second angle is 45° and the third angle is 90°.

Figure 12:
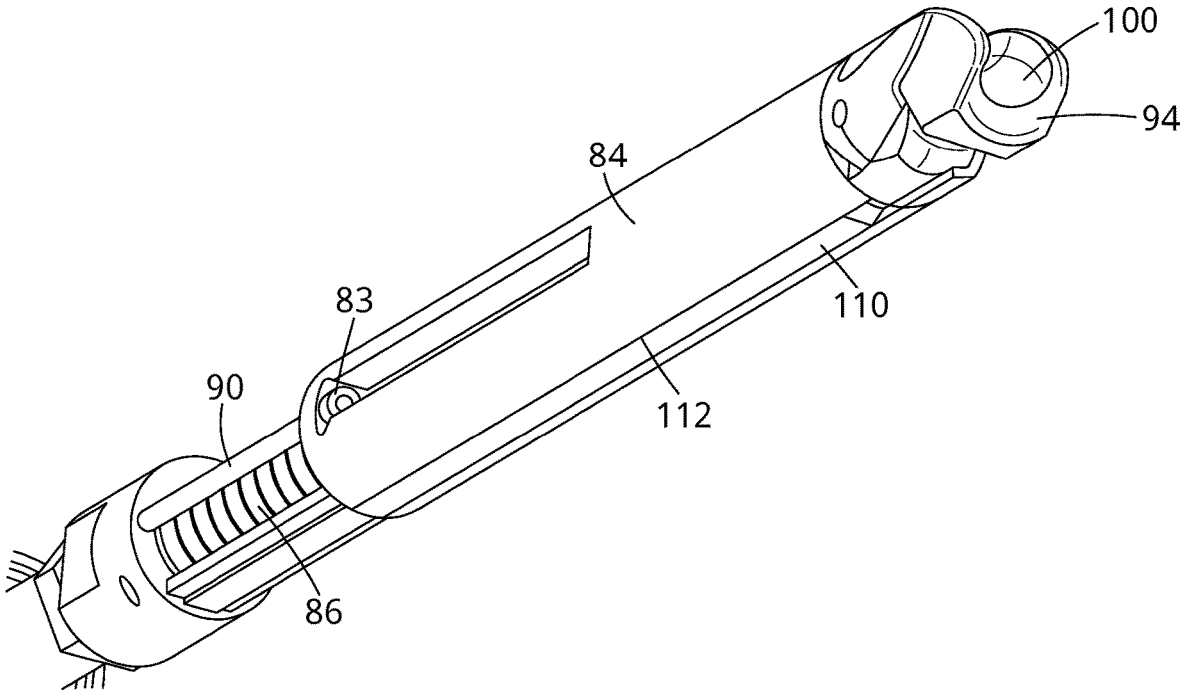
FIG. 12 is another perspective view of the front guide device and rear guide pipe.
Figure 13:
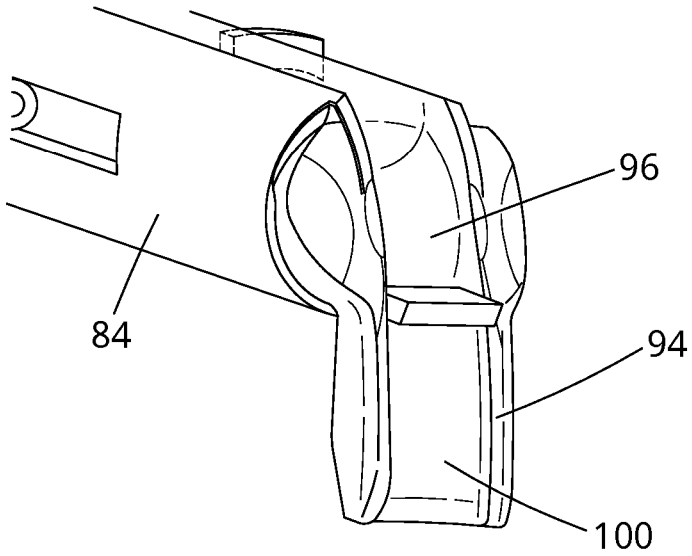
FIG. 13 is a perspective view of the front guide device.

As seen in FIG. 12, a cutting blade 110 extends forwardly from the seat 88 at the front end of the rear guide pipe 73. The cutting blade 110 is T-shaped in transverse section. The lower limb of the "T" of the cutting blade 110 extends along a longitudinally extending slot 112 in the front guide device 84 so as to be slidable relative thereto whilst being at least partially supported thereby. The insertion tube 30 inside which the front guide device 84 extends longitudinally may also provide some support to the cutting blade 110. The "T" shape of the cutting blade 110 also serves to provide it with inherent stiffness against buckling.

Figure 14:
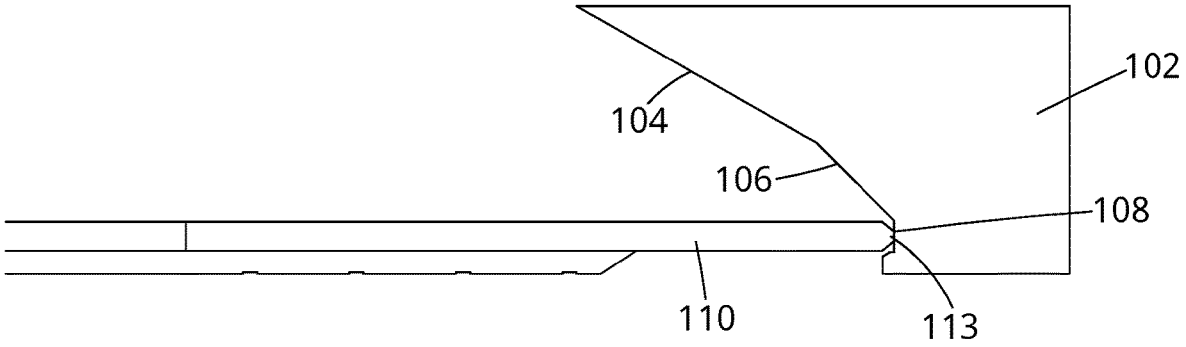
FIG. 14 is a side view of a front part of the front guide device and a cutting blade.
Figure 15:
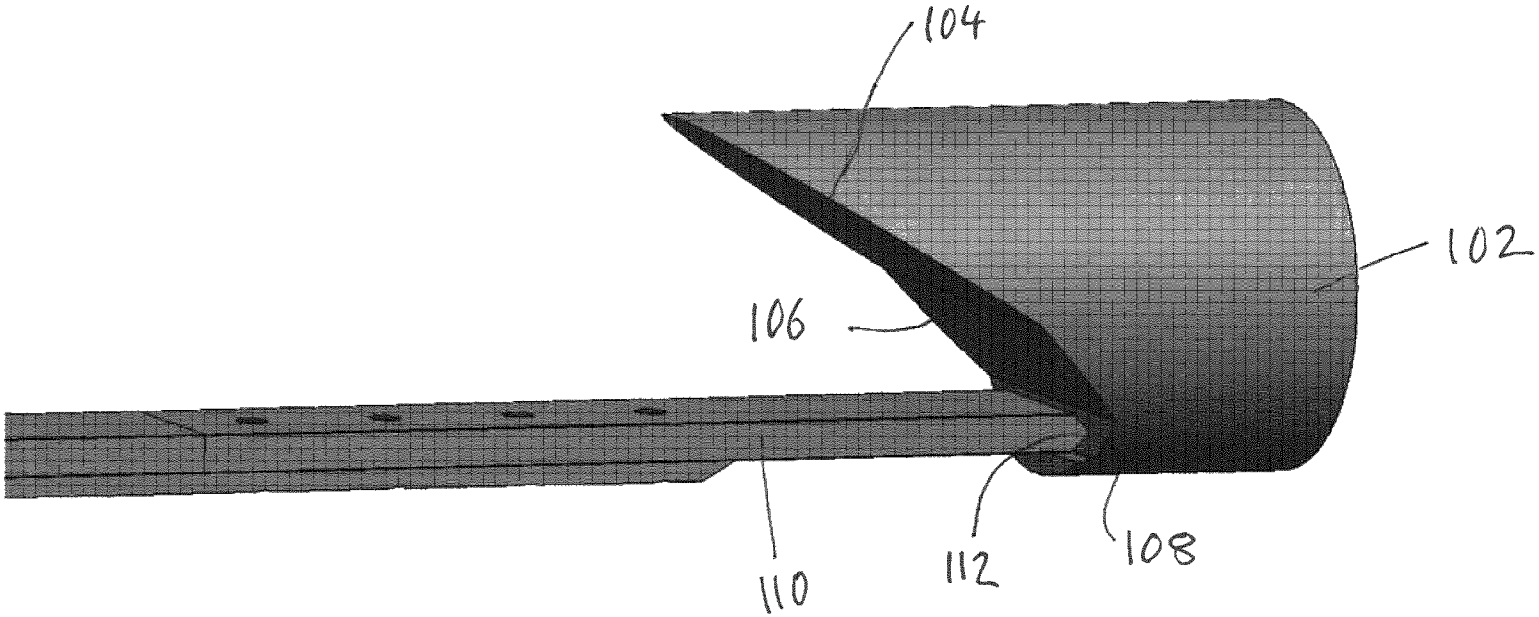
FIG. 15 is a perspective view showing the front part and the cutting blade.

At its front end the cutting blade 110 has a cutting edge 113 for cutting the hose 52 or other components of the flexible conduit. As will be described below, when the cutting blade 110 advances forwardly relative to the front guide device 84, its cutting edge moves towards the lower face 108 of the deflection member 102 until, having performed a cut, it engages with the lower face 108, as seen in FIGS. 14 and 15.

FIGS. 17A to 17D and FIGS. 18A to 18E show the apparatus of the second embodiment at different stages of operation, and the sequence of operation will be described with reference to those Figures.

Figure 18A:
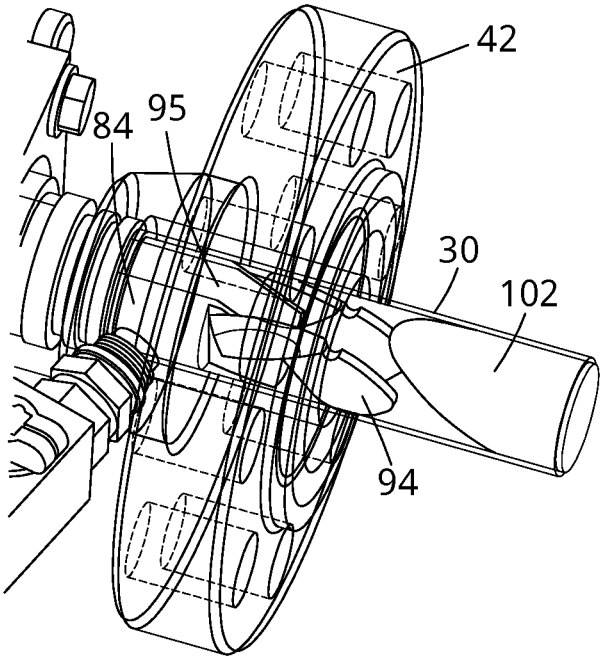
FIGS. 18A to 18E are further respective perspective views of the apparatus of FIG. 10 at different stages of its operation.

FIG. 18A shows part of the apparatus when the insertion tube 30 is in a retracted position, which is the condition of the apparatus when the flange 42 is to be sealingly bolted to the flange 19 of the wellhead 12. At this stage the front end of the insertion tube 30 projects a short distance into the lateral access passage of the wellhead 12. Once the apparatus has been secured to the wellhead 12, the valve 18 of the wellhead may be opened to allow the space within the insertion tube 30 and the rest of the probe container 28 to be exposed to well pressure.

Figure 18B:
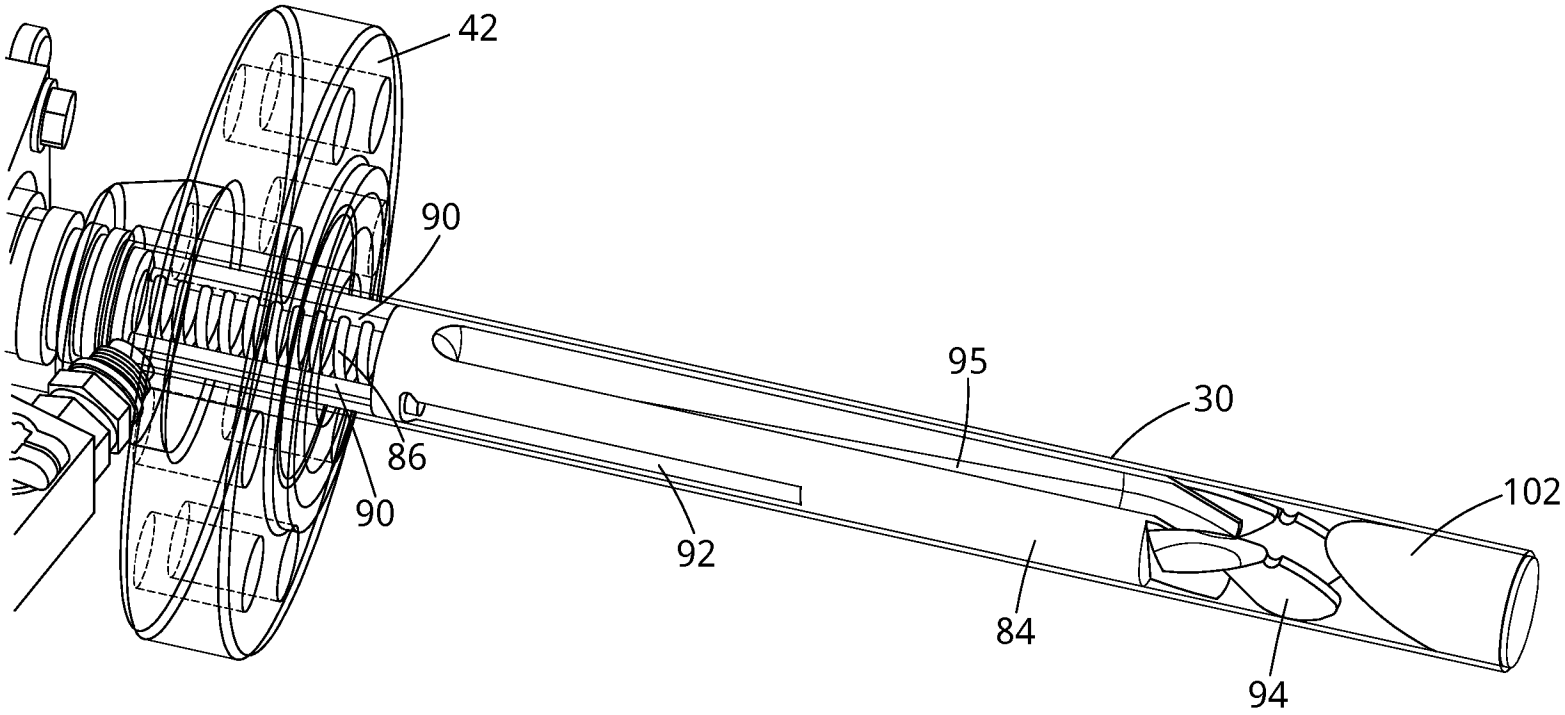

FIG. 18B shows part of the apparatus when the insertion tube 30 is in a forward position. The insertion tube has been advanced to this position by operation of the gearbox 64 to cause the nut 66 to be driven longitudinally forwardly and thereby move the hydraulic unit 70 longitudinally forwardly therewith. During this process the front guide device 84 is in a rearward position relative to the insertion tube 30. The guide tongue 94 is in its upper position, with its profile as viewed in the direction of lateral insertion contained within the internal diameter of the insertion tube 30. At this stage, a front end portion of the front guide device 84 protrudes forwardly out of the lateral access passage of the wellhead 12 and into the annular cavity 22 (see FIG. 1).

Figure 17A:
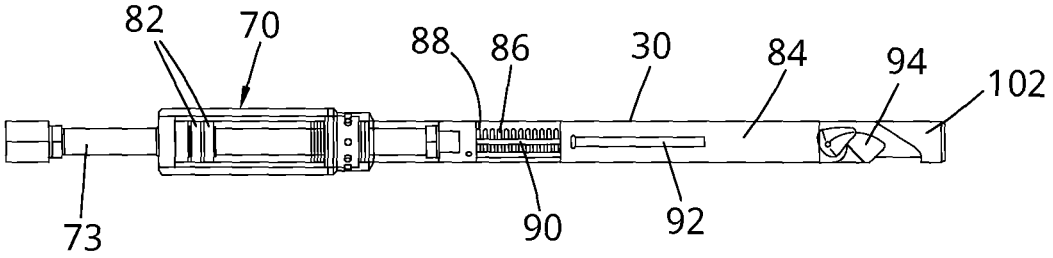
FIGS. 17A to 17D are respective side views of the apparatus of FIG. 10, showing the apparatus at different stages of its operation.

FIG. 17A shows the status of the hydraulic unit 70 at this stage, with the pair of intermediate seals 82 located at a rear position. As seen in FIGS. 11, 17A and 18B, the front end portions of the guide bars 90 are in engagement with the forwardly facing abutments 83 of the front guide device 84, and are held in this engagement by the compressive force of the spring 86 which urges the front guide device 84 forwardly relative to the seat 88 at the front end of the rear guide pipe 73.

Figure 17B:
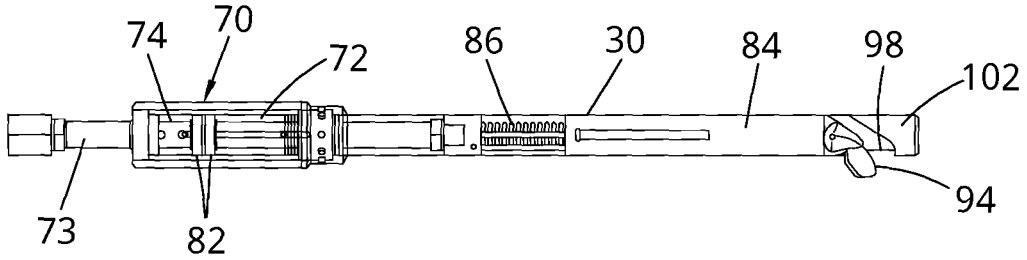

In order to cause the guide tongue 94 to drop under gravity to its lower position, it is necessary for it to be advanced sufficiently forwardly to emerge via the opening 98 in the insertion tube 30, as seen in FIG. 17B. This is achieved by forward advancement of the front guide device 84 relative to the insertion tube 30, caused by operation of the hydraulic unit 70 by pressurising rear hydraulic chamber 74 and causing the pair of intermediate seals 82 to advance forwardly and so causing the rear guide pipe 73 to advance forwardly. During this forward advancement, the spring 86 does not compress and so the front guide device 84 is maintained in a forward position relative to the rear guide pipe 73.

The flexible conduit 50, as described in relation to the first embodiment, is then driven forwardly through the apparatus and into the well. The flexible conduit 50 comprises a hose 52 and, at a front end of the hose 52, a probe in the form of a downhole spring 54. As the flexible conduit 50 is forwardly driven, the downhole spring 54 is guided along the channel 95. The channel slopes upwardly from rear to front as it extends longitudinally and the front end of the downhole spring 54 is guided along the channel towards the deflection member 102 fixed at the front end of the insertion tube 30. With continued advancement, the front end of the spring 54 engages the upper face 104 of the deflection member 102 (see FIG. 14) and is deviated generally downwardly by the upper face 104, due to the upper face being at an angle to the longitudinal direction. Moving further forwardly, the front end of the spring 54 engages the intermediate face 106 which assists in deviating it further downwardly, until it starts to advance downwardly into the annular cavity 22.

Initially, because the spring tends to self straighten, it curves from the channel 95 round to the downward direction without necessarily contacting the guide tongue channel 100. The spring curves with a relatively large radius of curvature and so offers a relatively low resistance to further driving forward of the flexible conduit 50.

Figure 18C:
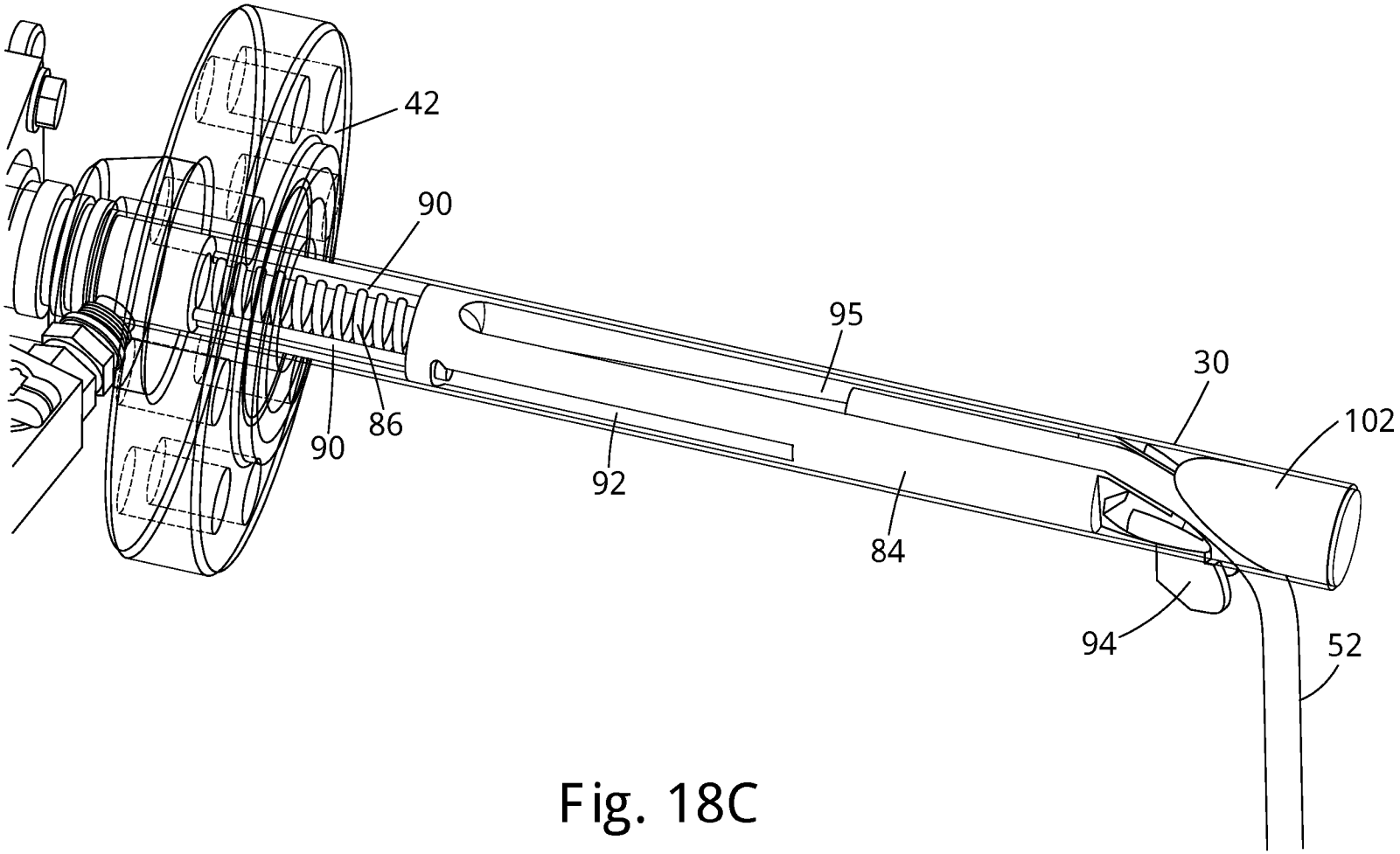

FIG. 18C shows the hose 52 which is being forwardly transported behind the spring 54. At this stage the hose is not in contact with the guide tongue channel 100, because it is adopting the maximum radius of curvature available to it, between the front of the channel 95 and the faces of the deflection member 102. As the amount of the flexible conduit 50 in the annular cavity 22 increases, its weight tends to cause the hose 52 to drop into the guide tongue channel 100. In some embodiments, the weight necessary for the flexible conduit 50 engage in the guide tongue channel 100 may occur whilst the spring 54 is still emerging from the insertion tube 30, before the hose 52 has reached the front of the insertion tube 30.

The combination of the curved front portion 96 of the channel 95 and the guide tongue channel 100 (see FIG. 13) allow the transition from the slightly upward orientation of the flexible conduit in the channel 95 to the downward orientation in the well to take place with a relatively large radius of curvature. Approximately 45° to 50° of the change of direction occurs on the curved front portion 96, and approximately 45° of the change of direction occurs on the guide tongue channel 100. Part of the curving occurs within the profile of the insertion tube 30 as viewed in the direction of lateral insertion, and the remaining part of the curving occurs outside of this profile, thus increasing the radius of curvature compared to that which would be available if only using the space within the profile.

After a well intervention operation is complete, it is normally desired to withdraw the flexible conduit 50 from the well. During this process, the guide tongue channel 100 and the curved front portion 96 serve to guide the flexible conduit 50 from the downward direction to the horizontal direction. The relatively large radius of curvature provided by the guide tongue channel 100 and the curved front portion 96 assist in managing the transition at this stage, when relatively large tension forces may be present due to the weight of the part of the flexible conduit 50 extending downwardly into the well.

Once the flexible conduit 50 has been withdrawn from the well and from the apparatus 10, the guide tongue 94 may be returned to its upper position by operating the hydraulic unit in reverse, i.e. by pressurising the front hydraulic chamber 72. The rear guide pipe 73 is retracted rearwardly, bringing the front guide device 84 with it. After that, the insertion tube 30 is withdrawn by operation of the gearbox 64 to cause the nut 66 to be driven longitudinally rearwardly and thereby move the hydraulic unit 70 longitudinally rearwardly therewith. The insertion tube 30 reaches the retracted position shown in FIG. 18A, and the valve 18 of the wellhead 12 is closed. The apparatus 10 may then be removed from the wellhead.

There may be occasions when the flexible conduit 50 becomes stuck in the well and it is not possible to withdraw it. The apparatus 10 of the second embodiment enables cutting of the flexible conduit 50 at a location inside the well. Once that has been done, the portion of the flexible hose to the rear of the cut may be retracted and the procedure described above for removing the apparatus 10 from the well may be carried out. This enables the valve 18 of the well to be used to close the lateral access passage in the usual way.

The process by which the flexible conduit 50 is cut will be described below with reference to FIGS. 17B to 17D and FIGS. 18D and 18E.

Figure 17C:
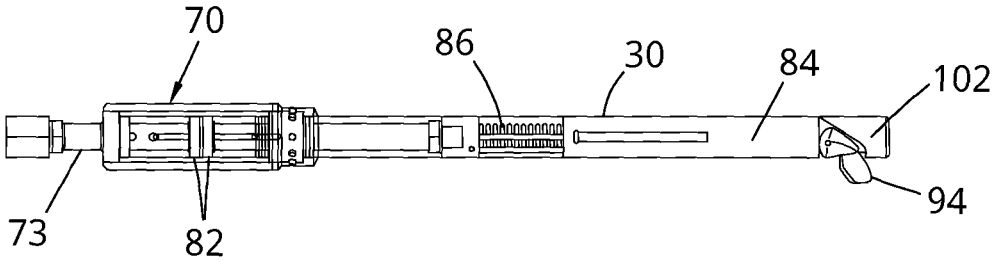
Figure 18D:
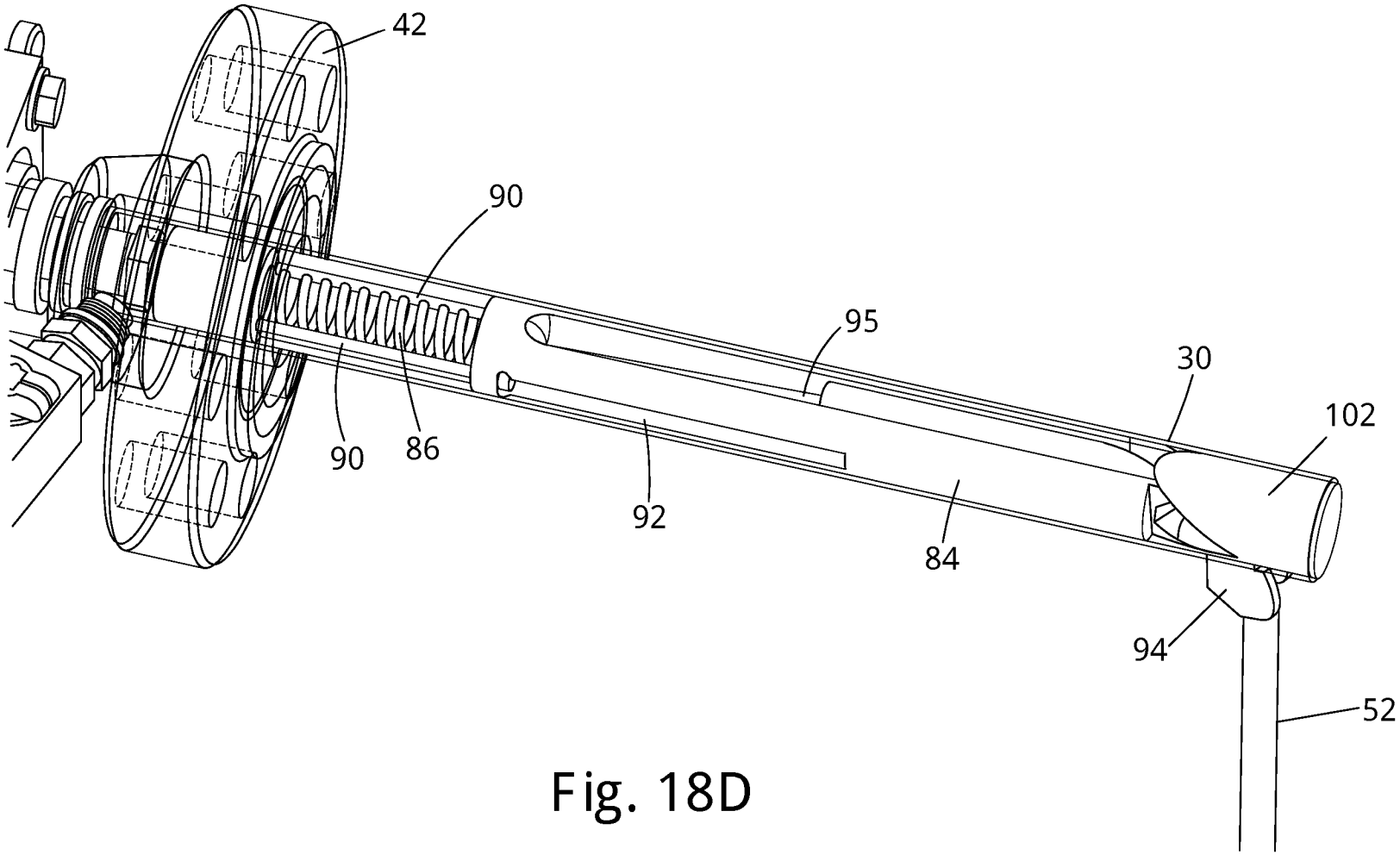

FIG. 17B shows the insertion tube 30 and the front guide device 84 in the position for normal deployment and retraction of the flexible conduit 50. The hydraulic unit 70 is operated by pressurising the rear hydraulic chamber 74 to move the rear guide pipe 73 forwardly, from the position shown in FIG. 17B to that shown in FIG. 17C. The spring 86 is not compressed during this process and so the rear guide pipe 73 and the front guide device 84 maintain the same relative positions. Since the insertion tube 30 is fixed to the hydraulic unit 70, it maintains its position and the front guide device 84 moves forwardly relative to the insertion tube 30. As a result the front of the front guide device 84 and the guide tongue 94 pivotally attached thereto advance towards the deflection member 102. This condition is shown in FIGS. 17C and 18D.

Figure 17D:
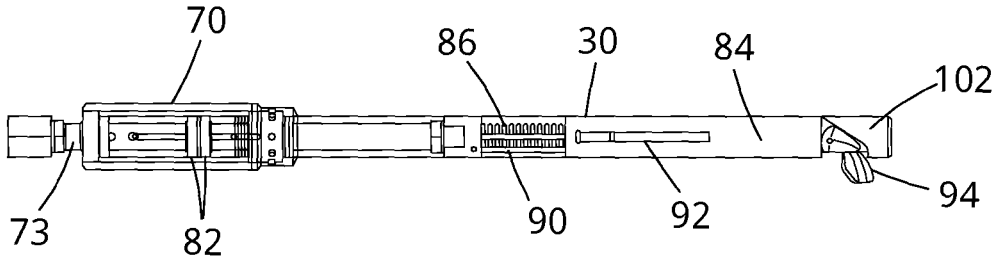
Figure 18E:
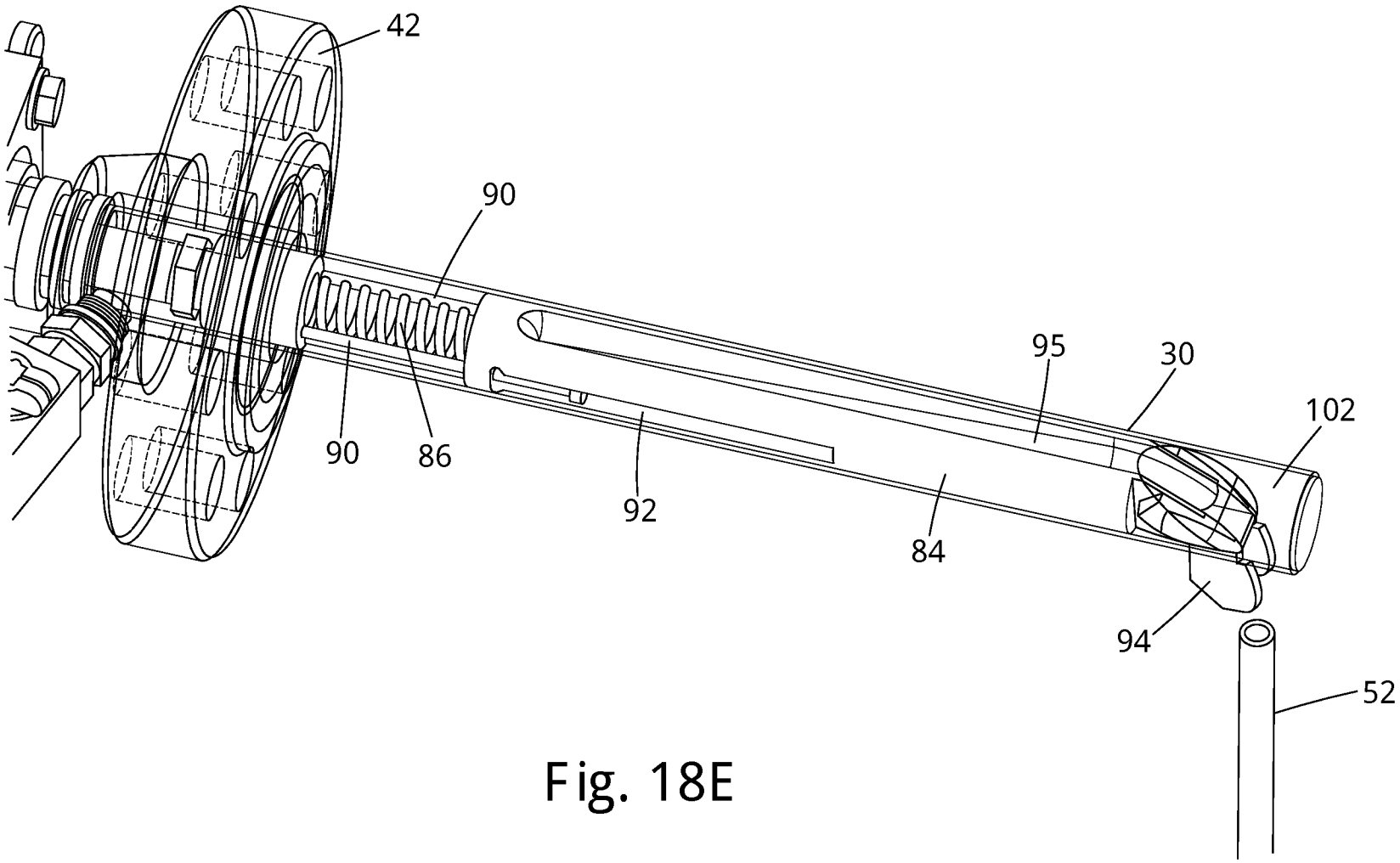

The rear hydraulic chamber 74 of the hydraulic device 70 is further pressurised to move the rear guide pipe 73 forwardly. At this stage the hose 52 occupies the space between the guide tongue channel 100 and the deflection member 102, creating a resistance to further advancement of the front guide device 84. Advancement of the rear guide pipe 73 therefore causes the spring 86 to compress and the guide bars 90 to advance along the slots 92 in the wall of the front guide device 84. This condition is shown in FIGS. 17D and 18E.

The cutting blade 110 extends forwardly from the seat 88 at the front end of the rear guide pipe 73. The cutting blade 110 advances with the rear guide pipe 73 and its cutting edge 113 starts to cut through the hose 52. The completed cut is shown in FIG. 18E. FIG. 14 shows the cutting blade 110 in a fully advanced position, with its cutting edge 113 engaging the lower face 108 of the deflection member 102.

Figure 19:
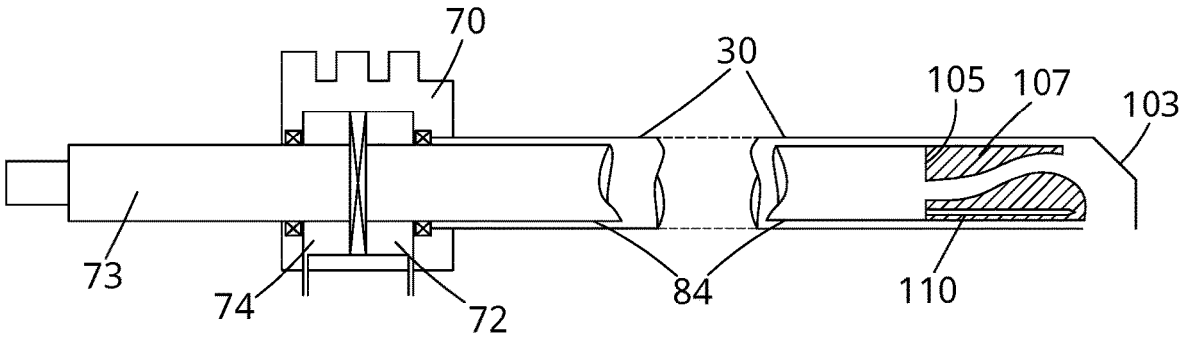
FIG. 19 is a schematic view of a third embodiment.

A third embodiment of the apparatus 10 will be described with reference to FIG. 19. The apparatus has the same features as that of the second embodiment, except that the front guide device 84 is fixed with respect to the rear guide pipe 73, without the spring 86 being provided between these two components. The third embodiment also does not have the deflection member 102 of the second embodiment, but employs a different arrangement, as described below.

A resilient body 107 is fixed to a connection surface 105 at the front of the front guide device 84. A cutting blade 110 is also fixed to the connection surface 105 and extends forwardly in a slot provided in the resilient body 107. The resilient body 107 is capable of being resiliently compressed in the longitudinal direction, i.e. the direction of lateral insertion into the lateral access passage of a well. The resilient body 107 may be made of a suitable elastomeric material.

The insertion tube 30 has at its front end a deflection surface 103 at an angle of approximately 45° to the direction of lateral insertion. The deflection surface 103 is generally aligned with a mouth 109 of the channel 95 through the resilient body 107, which rises upwardly along the length of the resilient body. Forwardly of the mouth 109 of the channel 95, the channel 95 has a curved front portion 96 providing a transition from the upward curvature towards a downward direction.

The operation of the third embodiment will be described with reference to FIGS. 20A to 20L.

Figure 20A:
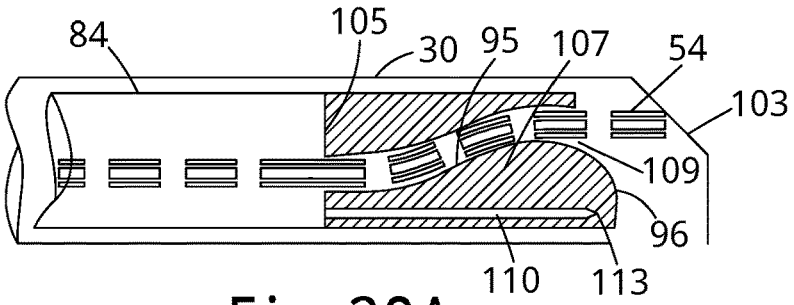
Figure 20B:
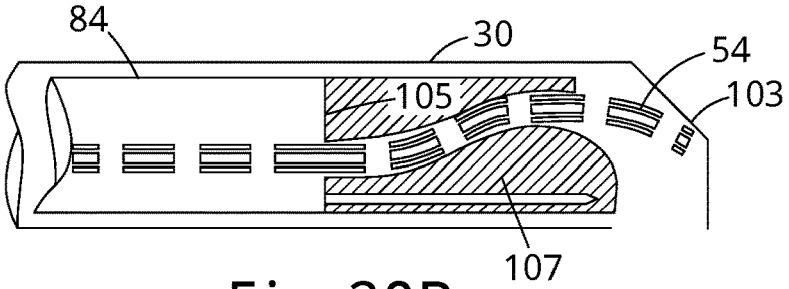
Figure 20C:
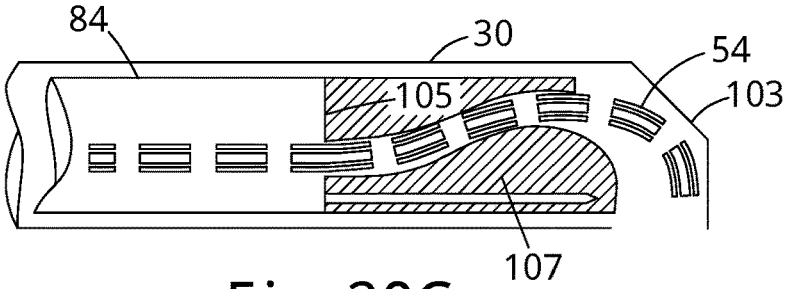
Figure 20D:
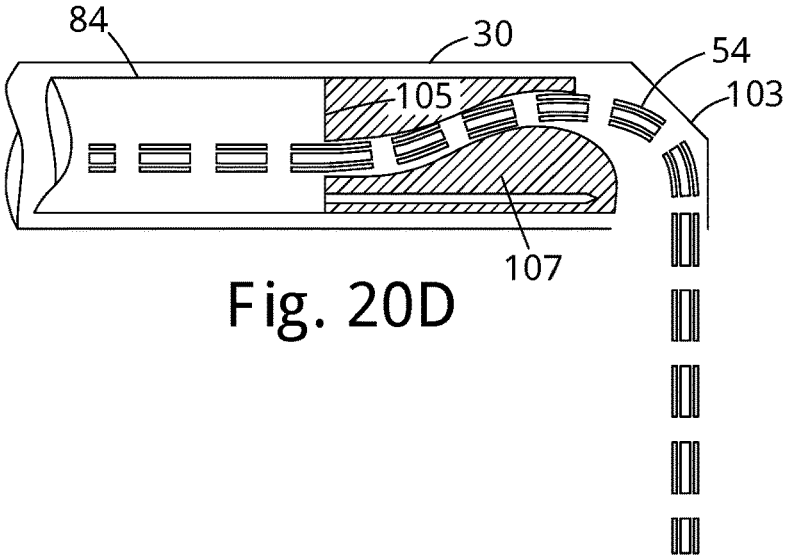

FIG. 20A shows the apparatus in its configuration for deployment of the flexible conduit 50 into a well. The flexible conduit 50 has at its front end a probe in the form of a downhole spring 54. This is forwardly advanced along the front guide device 84 and into the channel 95 in the resilient body 107. The channel 95 guides the spring 54 upwardly. The spring emerges from the mouth 109 of the channel 95 and strikes against the deflection surface 103 of the insertion tube 30, causing the spring to deviate from a generally horizontal or upward orientation towards a downward orientation. With further advancement of the spring 54 it adopts the positions shown in sequence in FIGS. 20B to 20D. As can be seen in FIG. 20D, between the mouth 109 of the channel 95 and the frontmost part of the insertion tube 30, the spring is not closely guided, but rather it can adopt the largest radius available in the space between the resilient body 107 and that frontmost part.

Figure 20E:
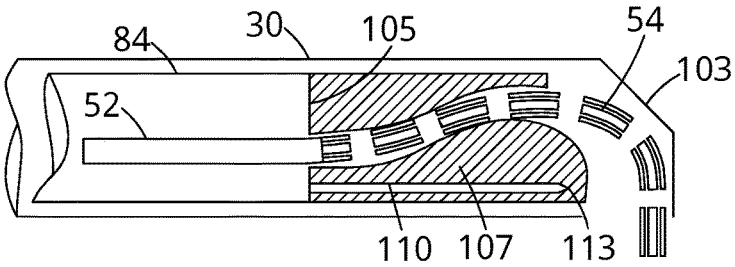
Figure 20F:
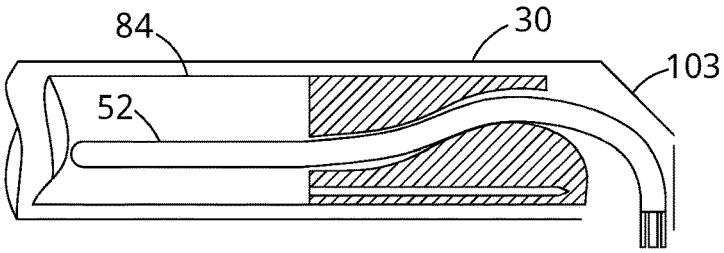
Figure 20G:
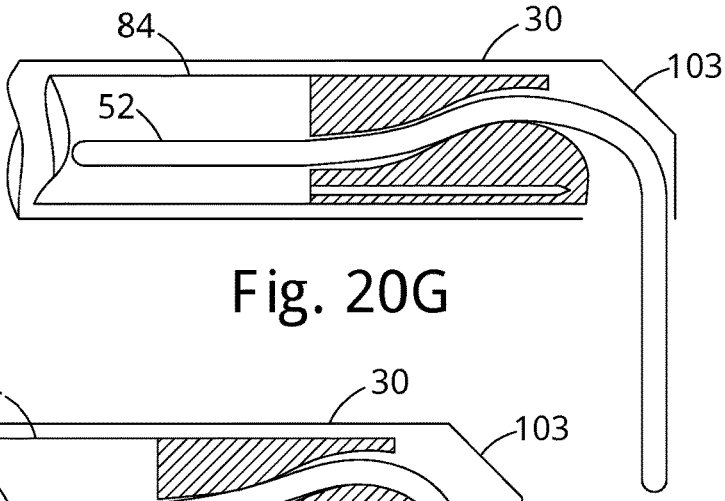
Figure 20H:
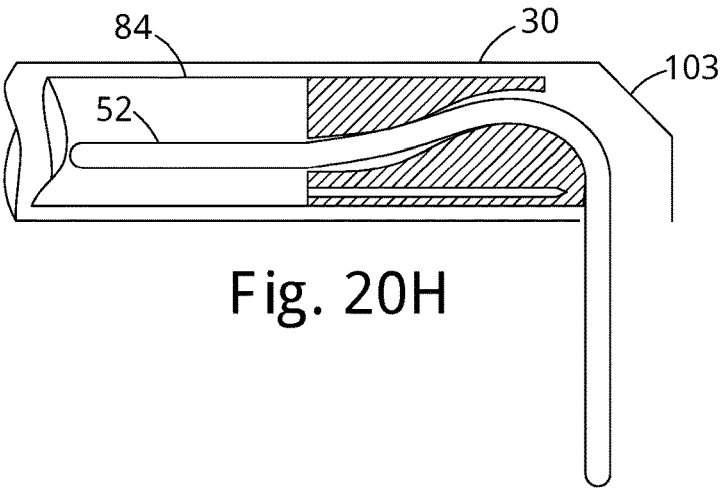

The hose 52 is attached behind the downhole spring 54 and is also advanced forwardly. It follows the path of the spring 54, as shown in FIGS. 20E to 20G. At the stage shown in FIG. 20H, the weight of the spring 54 and the hose 52 forwardly and downwardly of the insertion tube 30 has pulled the hose 52 from the large radius condition shown in FIG. 20G to a smaller radius condition shown in FIG. 20H, so that the hose 52 then lies against the curved front portion 96 of the channel 95. At this stage the radius of curvature adopted by the hose 52 is necessarily reduced, due to the effect of gravity.

Figure 20J:
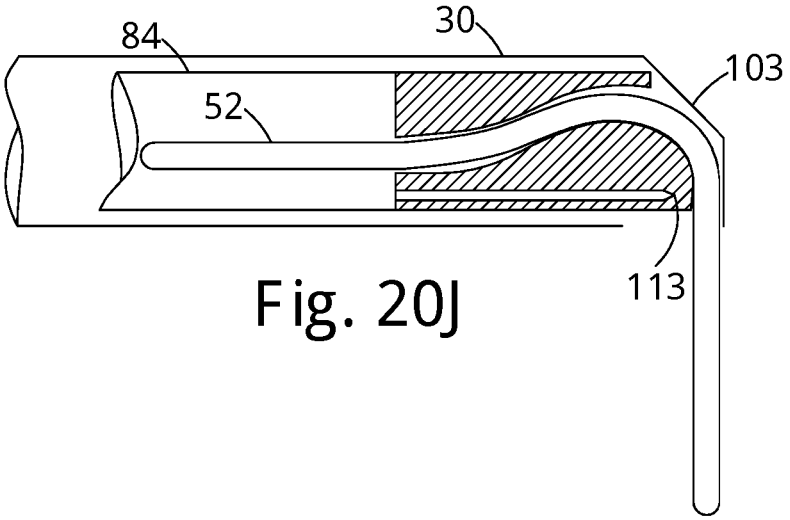
Figure 20K:
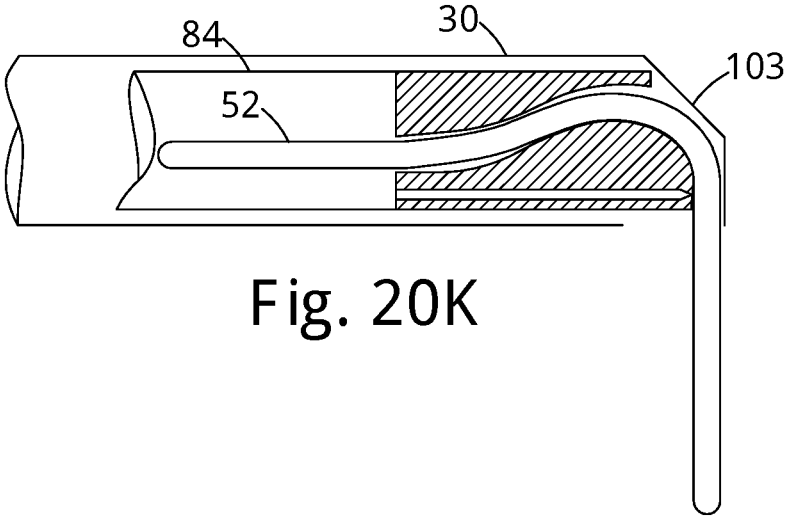

As with the second embodiment, it may be desired to cut the flexible conduit 50 at a location where it is in the well. The cutting procedure will be described with reference to FIGS. 20J to 20L. In FIG. 20J, the front guide device 84 has been advanced forwardly relative to the insertion tube 30, by operation of the hydraulic device 70 described in relation to the second embodiment. The resilient body 107 engages the hose 52 and thus its front part encounters resistance to further advancement. The hydraulic unit 70 is operated to move the front guide device 84 forwardly despite this resistance, causing the resilient body 107 to compress in the direction of lateral insertion, or in the longitudinal direction of the resilient body 107. The cutting blade 110 is fixed to the connection surface 105 at the front of the front guide device 84, so that the cutting blade 110 advances along the slot in the resilient body to reach the front part thereof, as shown in FIG. 20K. At this stage the cutting edge 113 engages with the hose 52.

Figure 20L:
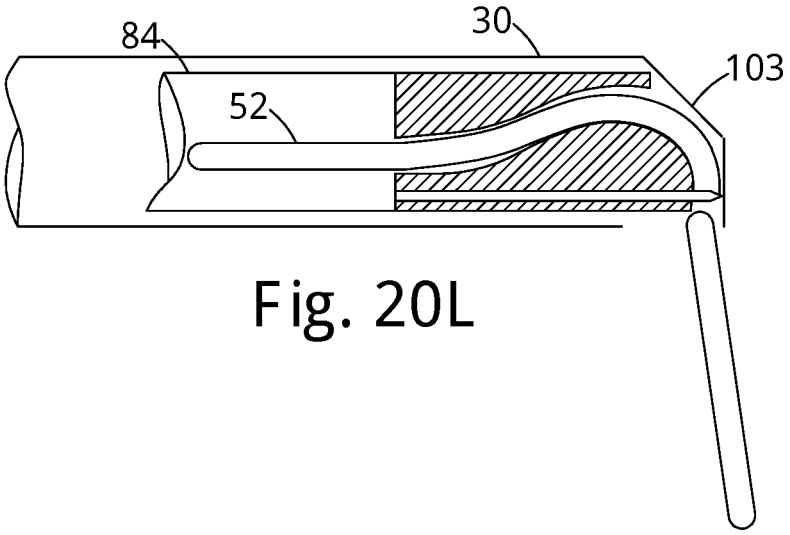

As the hydraulic unit is operated to advance the front guide device 84 further forwardly, the cutting blade 110 moves forwardly and cuts through the hose 52, as seen in FIG. 20L. Once that has been done, the portion of the flexible hose to the rear of the cut may be retracted and the procedure described above in relation to the second embodiment for removing the apparatus 10 from the well may be carried out. This enables the valve 18 of the well to be used to close the lateral access passage in the usual way.

Although not shown, the various embodiments of the apparatus may include a shear and seal valve, of a type known in the art, which can be closed if a leak occurs in the pressure containment system.

The invention claimed is:

1. Apparatus for gaining access to a well via a lateral access passage, the lateral access passage comprising a side opening in a wall of the well, the apparatus comprising a flexible conduit which is to be inserted into the well via the lateral access passage, the flexible conduit comprising a probe at a front end thereof, and the apparatus comprising a probe container for containing the probe before it is inserted into the well and whilst the probe is exposed to well pressure in the probe container, the probe container comprising a flexible tube and containing the probe with at least part of the probe extending along a curved path and the flexible conduit being drivable forwardly along the probe container, so that the flexible conduit is drivable along the probe container to advance the probe forwardly of the probe container and into the well via the probe container and the lateral access passage, and further comprising a drive mechanism for advancing the flexible conduit and probe towards or along the lateral access passage.

2. The apparatus of claim 1, wherein the probe comprises a spring.

3. The apparatus of claim 2, wherein the probe spring is a coil spring.

4. The apparatus of claim 1, comprising a probe container seal around the probe container.

5. The apparatus of claim 1, comprising a flexible conduit seal around the flexible conduit and sealing between the flexible conduit and an inner periphery of the probe container.

6. The apparatus of claim 1, comprising a spool on which the probe container is wound.

7. The apparatus of claim 1, comprising a guide for insertion along the lateral access passage and for assisting deviation of the flexible conduit from a direction of lateral insertion to a generally downward direction, the guide being resiliently biased so that when a forward end portion thereof extends out of the lateral access passage into the well, the resilient bias causes the forward end portion to be directed at least partly downwardly in the well.

8. Apparatus for gaining access to a well via a lateral access passage, comprising a flexible conduit which is to be inserted into the well via the lateral access passage, the flexible conduit comprising a probe at a front end thereof, and the apparatus comprising a probe container for containing the probe before it is inserted into the well and whilst the probe is exposed to well pressure in the probe container, the probe container comprising a flexible tube and containing the probe with at least part of the probe extending along a curved path, the apparatus further comprising a first seal provided around the probe container to allow forward advancement thereof, a second seal provided around the flexible conduit to seal between the flexible conduit and an inner periphery of the probe container, the first seal being located forwardly of the second seal, and the probe container being configured to accommodate the probe before it is inserted into the well and whilst the probe is exposed to well pressure in the probe container with at least part of the probe extending between the first seal and the second seal along a curved path.

9. Apparatus for gaining access to a well via a lateral access passage, comprising a flexible conduit which is to be inserted into the well via the lateral access passage, the flexible conduit comprising a probe at a front end thereof, and the apparatus comprising a probe container for containing the probe before it is inserted into the well and whilst the probe is exposed to well pressure in the probe container, the probe container comprising a flexible tube and containing the probe with at least part of the probe extending along a curved path, the apparatus further comprising a head portion configured to be inserted into the lateral access passage and to guide the flexible conduit into the well, and a cutting blade configured to cut the flexible conduit when it extends into the well, wherein the head portion comprises a cutting surface opposed to the cutting blade, whereby during cutting of the flexible conduit the cutting blade cuts through the flexible conduit as the cutting blade is advanced towards the cutting surface.

10. The apparatus of claim 9, wherein the head portion comprises a resilient device configured to compress in the direction of forward insertion of the head portion during cutting of the flexible conduit.

* * * * *